US010639698B2

(12) United States Patent
Yasutomi et al.

(10) Patent No.: US 10,639,698 B2
(45) Date of Patent: May 5, 2020

(54) SHEARING METHOD

(71) Applicant: NIPPON STEEL & SUMITOMO METAL CORPORATION, Tokyo (JP)

(72) Inventors: Takashi Yasutomi, Tokyo (JP); Takashi Matsuno, Tokyo (JP); Shigeru Yonemura, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 304 days.

(21) Appl. No.: 15/552,552

(22) PCT Filed: Feb. 25, 2016

(86) PCT No.: PCT/JP2016/055700

§ 371 (c)(1),
(2) Date: Aug. 22, 2017

(87) PCT Pub. No.: WO2016/136909

PCT Pub. Date: Sep. 1, 2016

(65) Prior Publication Data

US 2018/0333760 A1 Nov. 22, 2018

(30) Foreign Application Priority Data

Feb. 25, 2015 (JP) ..... 2015-034874
Feb. 8, 2016 (JP) ..... 2016-022164

(51) Int. Cl.
*B21D 28/14* (2006.01)
*B21D 28/16* (2006.01)

(52) U.S. Cl.
CPC ..... *B21D 28/14* (2013.01); *B21D 28/16* (2013.01)

(58) Field of Classification Search
CPC ..... B21D 28/00; B21D 28/02; B21D 28/14; B21D 28/16; B21D 28/24; B21D 28/26; B21D 28/34; B21D 28/343
(Continued)

(56) References Cited

U.S. PATENT DOCUMENTS 4,586,360 A 5/1986 Jürgensmeyer et al.
2008/0196471 A1* 8/2008 Fellenberg ..... B21D 28/02 72/324
2014/0017443 A1 1/2014 Matsuda

FOREIGN PATENT DOCUMENTS

JP 47-28629 B1 7/1972
JP 60-68118 A 4/1985
(Continued)

OTHER PUBLICATIONS

Machine Translation of JP-05161926-A, Narita, Takumi, pp. 1-10, Translated on Aug. 9, 2019 (Year: 2019).*
(Continued)

*Primary Examiner* — Debra M Sullivan
*Assistant Examiner* — Matthew Kresse
(74) *Attorney, Agent, or Firm* — Birch, Stewart, Kolasch & Birch, LLP

(57) ABSTRACT

Provided is a steel material shearing method that enables highly productive and low-cost production of a steel material with a sheared surface having excellent hydrogen embrittlement resistance, fatigue strength, and stretch flangeability. The shearing method comprises making a clearance between a die and a punch 5 to 80% of a sheet thickness of a workpiece, shearing the workpiece using the punch, and, by utilizing a punched material punched out by the punch, pressing an end face of the punched out material against the sheared surface of the worked material on the die to produce a steel sheet with a sheared edge having excellent hydrogen embrittlement resistance and fatigue strength.

25 Claims, 22 Drawing Sheets

(58) Field of Classification Search
USPC ..... 83/514, 515, 517, 518, 618–622, 670, 83/681, 682, 684–686
See application file for complete search history.

(56) References Cited

FOREIGN PATENT DOCUMENTS

| | | | |
|---|---|---|---|
| JP | 3-207532 | A | 9/1991 |
| JP | 5-161926 | A | 6/1993 |
| JP | 2002-263748 | A | 9/2002 |
| JP | 2006-82099 | A | 3/2006 |
| JP | 2008-18481 | A | 1/2008 |
| JP | 2009-51001 | A | 3/2009 |
| JP | 2010-36195 | A | 2/2010 |
| JP | 2011-218373 | A | 11/2011 |
| JP | 2014-18801 | A | 2/2014 |
| JP | 2014-231094 | A | 12/2014 |

OTHER PUBLICATIONS

Machine English translation of JP 2014-18801 A (Feb. 3, 2014).
Machine English translation of JP 47-28629 B (Jul. 28, 1972).
Machine English translation of JP 60-68118 A (Apr. 18, 1985).
"Press Process and Die Structure," Ministry of Labour and Social Security, Educational Materials Office, p. 20, China Labour and Social Security Publishing House, Apr. 2004, First Edition, with partial English translation.
International Search Report for PCT/JP2016/055700 dated Apr. 19, 2016.
Written Opinion of the International Searching Authority for PCT/JP2016/055700 (PCT/ISA/237) dated Apr. 19, 2016.

* cited by examiner

CLEARANCE SETTING PROCESS

SHEARING PROCESS

PUSHING PROCESS

SHEARING METHOD

TECHNICAL FIELD

The present invention relates to a shearing method for producing a metal member used in automobiles, household electric appliances, building structures, ships, bridges, construction machines, various plants, penstocks, etc., by a shearing operation wherein it is possible to form a sheared edge with excellent surface properties.

BACKGROUND ART

Shearing is made much use of in the production of the metal members used in automobiles, household electric appliances, building structures, ships, bridges, construction machines, various plants, penstocks, etc. FIGS. 1A and 1B schematically show modes of shearing. FIG. 1A schematically shows a mode of shearing for forming a hole in the workpiece, while FIG. 1B schematically shows a mode of shearing for forming an open section in the workpiece.

In the shearing operation shown in FIG. 1A, a workpiece 1 is arranged on a die 3, a punch 2 is pushed inward in the downward direction 2*a*, that is, the sheet thickness direction of the workpiece 1, to form a hole in the workpiece 1. In the shearing operation shown in FIG. 1B, the workpiece 1 is arranged on the die 3 and, similarly, the punch 2 is pushed inward in the downward direction 2*a*, that is, the sheet thickness direction of the workpiece 1, to form an open section in the workpiece 1.

A sheared edge 9 of a worked material 10 formed by a shearing operation usually, as shown in FIG. 2, is comprised of a shear droop 4, burnished surface 5, fracture surface 6, and burr 7. The shear droop 4 is formed at a surface 8*a* of a top part of the worked material 10 due to the workpiece 1 being pushed inward by the punch. The burnished surface 5 is formed by the workpiece 1 being locally stretched due to the workpiece 1 being pulled inward at the clearance between the punch and die. The fracture surface 6 is formed by the workpiece 1 pulled into the clearance between the punch and die breaking. The burr 7 is formed at a surface 8*b* of a bottom part of the worked material 10 when the workpiece 1 pulled into the clearance between the punch and die breaks and separates from the worked material 10.

The sheared edge is in general inferior in surface properties compared with the worked surface formed by machining. For example, it has the problems that the hydrogen embrittlement resistance is low, the fatigue strength is low, or strength flange cracking (cracking occurring at sheared edge due to press-forming after shearing) easily occurs. In particular, in high strength steel sheet, hydrogen embrittlement cracking and a drop in the fatigue strength easily occur due to tensile residual stress.

Various arts have been proposed for solving the problems with the sheared edge. These arts generally can be divided into ones which modify the structures of the punch and die to improve the fatigue strength, stretch flangeability, and other surface properties of the sheared edge (for example, see PLTs 1 to 3) and ones which treat the sheared edge by coining, shaving, etc. to improve the hydrogen embrittlement resistance, fatigue strength, and other surface properties of the sheared edge (for example, see PLTs 4 to 8).

However, with the arts of modifying the structures of the punch and die, there are limits to the improvement of the surface properties of the sheared edge, while with the art of treating the sheared edge, the productivity falls and the manufacturing costs rise by the amount of the increase of one process.

CITATION LIST

Patent Literature

PLT 1. Japanese Patent Publication No. 2009-051001A
PLT 2. Japanese Patent Publication No. 2014-231094A
PLT 3. Japanese Patent Publication No. 2010-036195A
PLT 4. Japanese Patent Publication No. 2008-018481A
PLT 5. Japanese Patent Publication No. 2011-218373A
PLT 6. Japanese Patent Publication No. 2006-082099A
PLT 7. Japanese Patent Publication No. 2002-263748A
PLT 8. Japanese Patent Publication No. 3-207532A

SUMMARY OF THE INVENTION

Problems to be Solved by the Invention

The present invention was made in consideration of the current state of the art of shearing and has as its object the provision of a shearing method able to produce a metal member having a sheared edge excellent in hydrogen embrittlement resistance and fatigue strength with a good productivity and at a low cost.

Means for Solving the Problems

The inventors studied in depth means for solving the above problem and obtained the discoveries that when shearing high strength steel sheet and other metal members, from the viewpoint of the hydrogen embrittlement resistance, it is best to make the clearance between the punch and die smaller, but it is difficult to precisely fabricate tooling with small clearance so fabrication of the tooling becomes very costly and that if the clearance between the punch and die is small, the tooling is easily damaged and, in particular, when shearing high strength steel sheet, damage to tooling is unavoidable.

The inventors engaged in further in-depth studies and as a result discovered that by setting the clearance between the die and punch to 5 to 80% of the sheet thickness of the workpiece and then performing the shearing operation and actively using the punched out material punched out by the punch and pushing the end face of the punched out material against the sheared edge of the worked material on the die, it is possible to produce a metal member having a sheared edge excellent in hydrogen embrittlement resistance and fatigue strength with a good productivity and low cost.

The present invention was made based on the above discovery and has as its gist the following:

(1) A shearing method in which a workpiece having a first surface and a second surface on the opposite side of the first surface is arranged on a die so that the second surface is arranged at the die side and the workpiece is sheared from the first surface toward the second surface in a sheet thickness direction of the workpiece by a punch arranged at the first surface side, wherein the shearing method comprises:

(A) a clearance setting process of making a clearance between the die and the punch in a direction perpendicular to the sheet thickness direction of the workpiece 5% to 80% of the sheet thickness of the workpiece, (B) a shearing process of using the punch to shear the workpiece to obtain a punched out material and a worked material, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, so as to push the punched out material in the state as punched into a punched hole of the worked material to push the end face of the punched out material against the sheared edge of the worked material.

(2) The shearing method according to (1), wherein, in the process (A), the clearance between the die and the punch is made 10% to 80%.

(3) The shearing method according to (1), wherein, in the process (A), the clearance between the die and the punch is made 10% to 30%.

(4) The shearing method according to any one of (1) to (3), wherein, in the process (C), the punched out material is pushed in by a range where the second surface of the punched out material does not pass the first surface of the worked material, so as to coin the sheared edge of the worked material.

(5) The shearing method according to any one of (1) to (3), wherein, in the process (C), the punched out material is pushed in by a range where a position of the second surface of the punched out material does not pass a position of half of the sheet thickness from the second surface to the first surface of the worked material, so as to coin the sheared edge of the worked material.

(6) The shearing method according to any one of (1) to (3), wherein, in the process (C), the punched out material is pushed in so that a position of the second surface of the punched out material becomes the same as the position of the second surface of the worked material, so as to coin the sheared edge of the worked material.

(7) The shearing method according to any one of (1) to (3), wherein, in the process (C), the punched out material is pushed in by a range where a position of the second surface of the punched out material does not pass the position of the second surface of the worked material, so as to coin at least part of the sheared edge of the worked material.

(8) The shearing method according to any one of (1) to (7), wherein, in the process (C), the punched out material pushed into the punched hole is punched out by the punch and the punched out material is pushed into the punched hole by the pushing punch repeatedly 1 time or more.

(9) The shearing method according to any one of (1) to (8), wherein the die, the punch, and the pushing punch have an outer trimming configuration wherein the die is arranged at an inner circumferential side of the workpiece, and the punch and the pushing punch are arranged at an outer circumferential side of the workpiece, at least one surface between a punching surface of the punch and a pushing surface of the pushing punch has a projecting part, and the shearing and the pushing are conducted while the punch and the pushing punch are gripping and fastening the workpiece between them.

(10) The shearing method according to any one of (1) to (8), wherein the die, the punch, and the pushing punch have an outer trimming configuration wherein the die is arranged at an inner circumferential side of the workpiece, and the punch and the pushing punch are arranged at an outer circumferential side of the workpiece, an additional punch is arranged linked with the punch at a further outer circumferential side from the punch, an additional pushing punch is arranged linked with the pushing punch at a further outer circumferential side from the pushing punch so as to be opposed to the additional punch across the workpiece, at least one surface between a punching surface of the additional punch and a pushing surface of the additional pushing punch has a projecting part, and the shearing and the pushing are conducted while the punching surfaces of the linked punch and additional punch and the pushing surfaces of the linked pushing punch and additional pushing punch are gripping and fastening the workpiece between them.

(11) The shearing method according to any one of (1) to (8), wherein:

the die, the punch, and the pushing punch have an outer trimming configuration wherein the die is arranged at an inner circumferential side of the workpiece, and the punch and the pushing punch are arranged at an outer circumferential side of the workpiece, an additional holder is arranged at a further outer circumferential side from the punch, an additional die is arranged at a further outer circumferential side from the pushing punch so as to be opposed to the additional holder across the workpiece, at least one surface between a fastening surface of the additional holder facing the first surface of the workpiece and a fastening surface of the additional die facing the second surface of the workpiece has a projecting part, and the shearing and the pushing are conducted while the fastening surface of the additional holder and the fastening surface of the additional die are gripping and fastening the workpiece between them.

(12) The shearing method according to any one of (1) to (8), wherein the die, the punch, and the pushing punch have an outer trimming configuration wherein the die is arranged at an inner circumferential side of the workpiece, and the punch and the pushing punch are arranged at an outer circumferential side of the workpiece, an additional punch is arranged at a further outer circumferential side from the punch, the additional punch and the pushing punch are used to shear the workpiece to obtain a burnished surface, and the clearance is set, the shearing is conducted and the pushing is conducted while the burnished surface is being constrained by a side surface of the additional punch.

(13) The shearing method according to any one of (1) to (8), wherein the die, the punch, and the pushing punch have an outer trimming configuration wherein the die is arranged at an inner circumferential side of the workpiece, and the punch and the pushing punch are arranged at an outer circumferential side of the workpiece, an additional die is arranged at a further outer circumferential side from the pushing punch, the punch and the additional die are used to shear the workpiece to obtain a burnished surface, and the clearance is set, the shearing is conducted and the pushing is conducted while the burnished surface is being constrained by a side surface of the additional die.

(14) The shearing method according to any one of (1) to (8), wherein the die, the punch, and the pushing punch have an outer trimming configuration wherein the die is arranged at an inner circumferential side of the workpiece, and the punch and the pushing punch are arranged at an outer circumferential side of the workpiece, an additional holder is arranged at a further outer circumferential side from the punch, an additional die is arranged at a further outer circumferential side from the pushing punch so as to be opposed to the additional holder across the workpiece, the punch and the additional die are used to shear the workpiece to obtain a burnished surface, and the clearance is set, the shearing is conducted and the pushing is conducted while the burnished surface is being constrained by a side surface of the additional die or additional holder.

(15) The shearing method according to any one of (1) to (14), wherein the workpiece is a metal sheet having a 340 MPa class or more tensile strength.

(16) The shearing method according to any one of (1) to (14), wherein the workpiece is a metal sheet having a 980 MPa class or more tensile strength.

(17) The shearing method according to (15) or (16), wherein the workpiece is a steel material.

Effect of the Invention

According to the present invention, it is possible to produce a metal member having sheared edge excellent in hydrogen embrittlement resistance and fatigue strength when shearing the metal member with a good productivity and at a low cost.

DESCRIPTION OF EMBODIMENTS

Figure 1B:
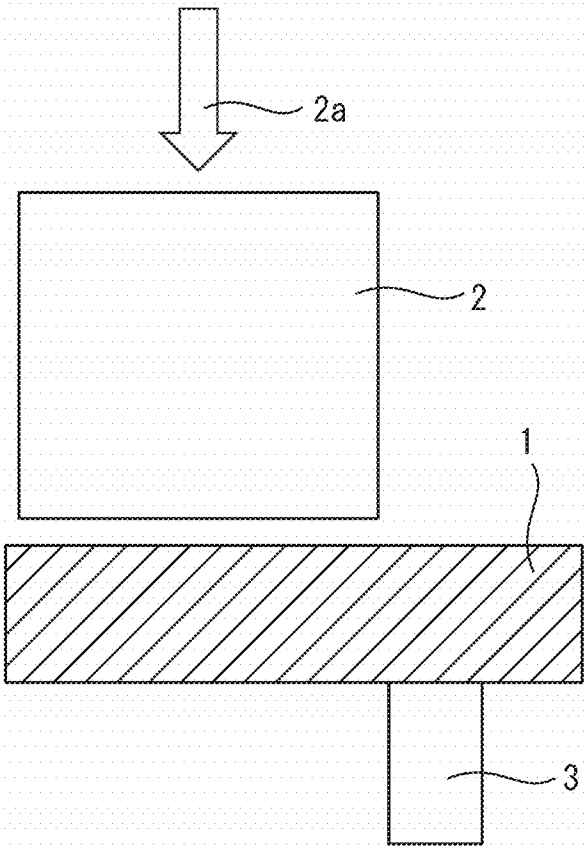
FIG. 1B is a cross-sectional schematic view showing a mode of shearing for forming an open section in a workpiece.
Figure 1A:
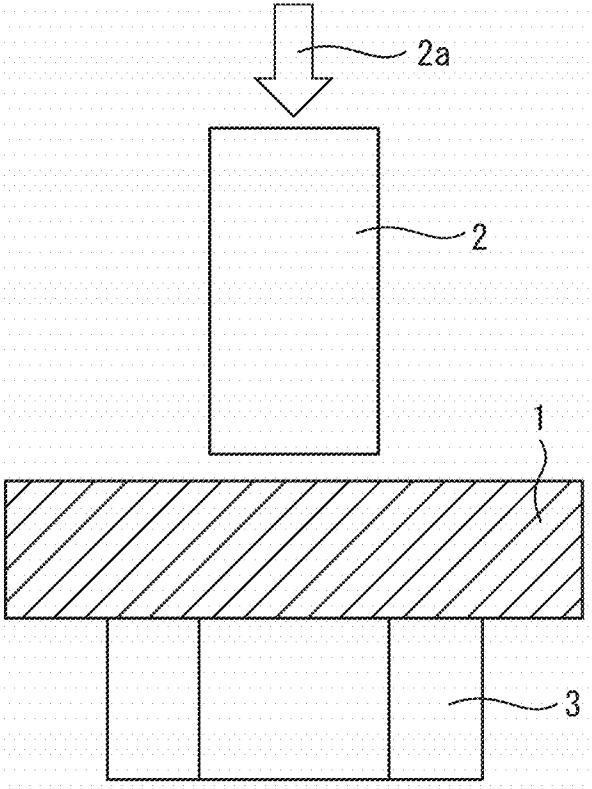
FIG. 1A is a cross-sectional schematic view showing a mode of shearing for forming a hole in a workpiece.

The shearing method of the present disclosure has as its basic idea a shearing method using a die and punch to shear a workpiece wherein a clearance between the die and punch (below, also referred to as the "clearance") is made a predetermined range or more for a shearing operation and the obtained punched out material is used as a tool for finely adjusting the sheared edge and is characterized by performing the shearing operation, then pushing the end face of the punched out material against the sheared edge of the worked material. In the present application, the workpiece is a metal member.

According to the method of the present disclosure, it is possible to enlarge the clearance between the die and punch. For this reason, a high dimensional precision such as in precision shearing is not demanded, tooling can be fabricated inexpensively, and damage to the tooling can be prevented. In particular, even when shearing high strength steel sheet, damage to the tooling is prevented and the need for repair and adjustment of the tooling is lightened, so the productivity rises. Furthermore, according to the method of the present disclosure, the punched out material punched out by the shearing operation is utilized in the punched out state as a tool for finely adjusting the sheared edge and, after the shearing operation, the end face of the punched out material is pushed against the sheared edge of the worked material. For this reason, it is no longer necessary to reset the punched out material at other tooling after the punching operation and possible to reduce the number of processes over the past. Further, since it is not necessary to reset the punched out material at separate tooling after the punching operation, no positional deviation of the punched out material occurs and the end face of the punched out material can be reliably pushed against the sheared edge of the worked material. Therefore, according to the method of the present disclosure, it is possible to produce a steel material having a sheared edge excellent in hydrogen embrittlement resistance and fatigue strength with a good productivity and at a low cost.

The method of the present disclosure sets the clearance between the die and punch larger, therefore is clearly differentiated from so-called fine blanking or other precision shearing. Note that, "precision shearing" is the method reducing the clearance as much as possible when punching a sheet so that the cut section as a whole is comprised of a burnished surface.

Below, the method of the present disclosure will be explained while referring to the drawings.

FIG. 3 to FIG. 7 show one example of the mode of using a shearing machine to shear a workpiece to obtain a punched out material and worked material, then making the punch rise and, in the state as punched, pushing back the punched out material to push it into the punched hole of the worked material.

Figure 3:
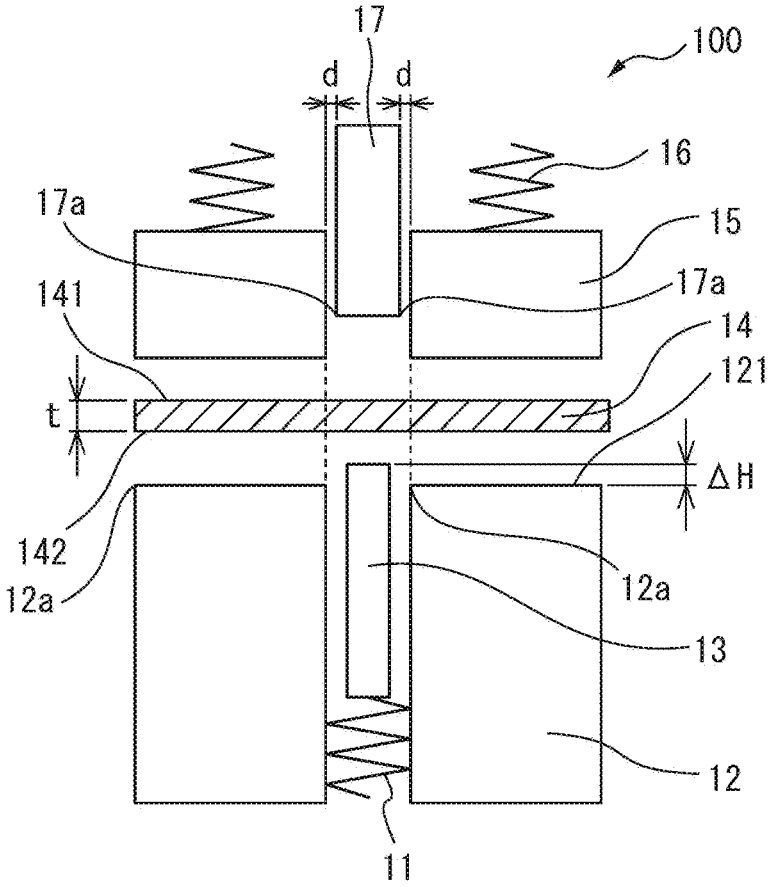
FIG. 3 is a cross-sectional schematic view showing a mode of arranging a workpiece at a shearing machine.
Figure 4:
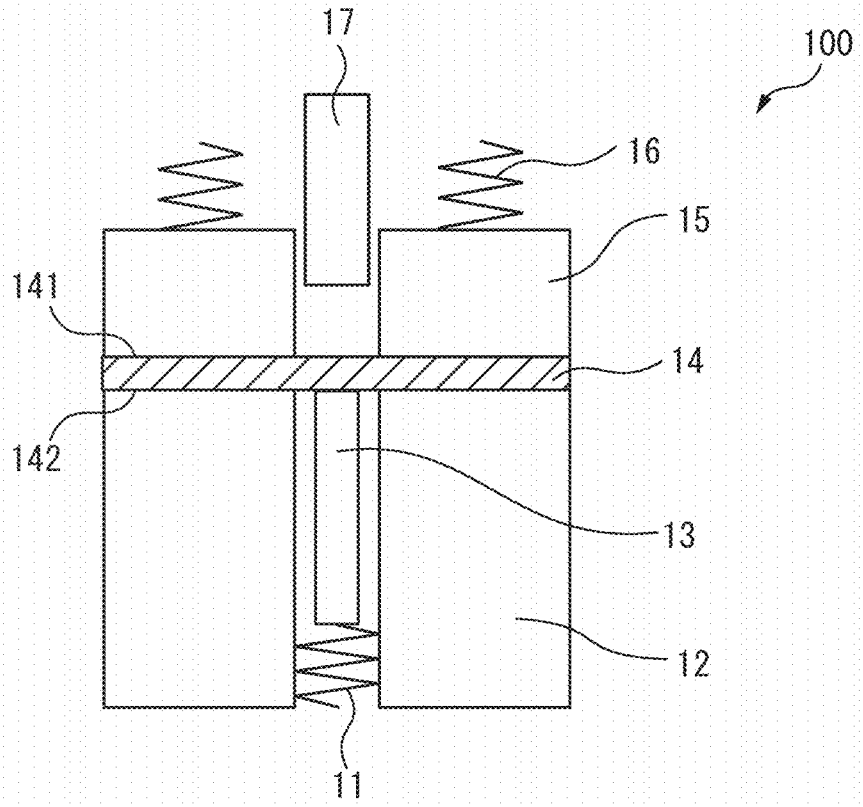
FIG. 4 is a cross-sectional schematic view showing a mode of fastening a workpiece at the shearing machine.
Figure 5:
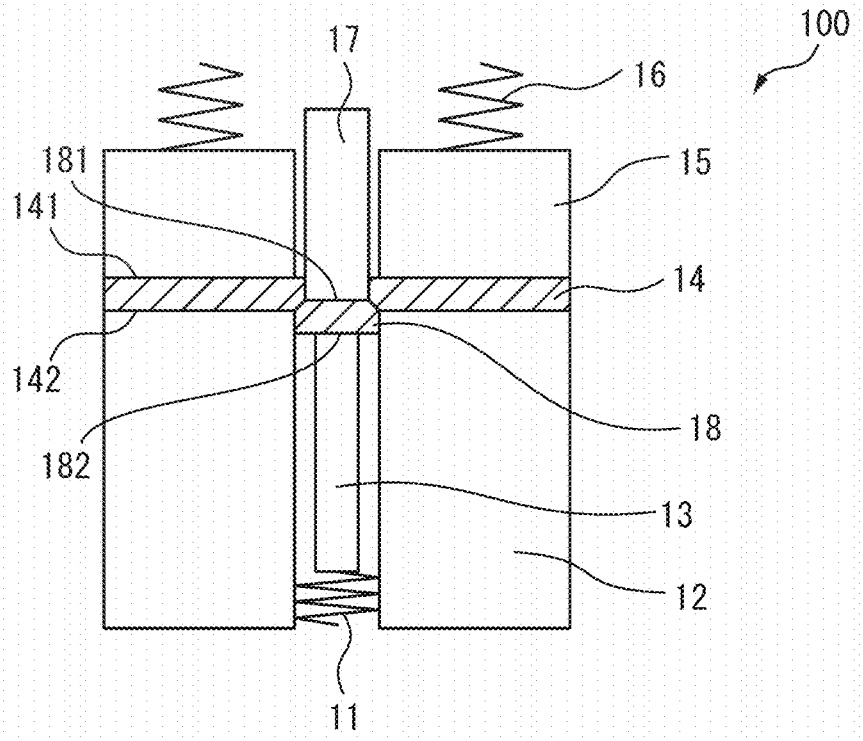
FIG. 5 is a cross-sectional schematic view showing a mode of pushing in a punch to shear a workpiece.
Figure 6:
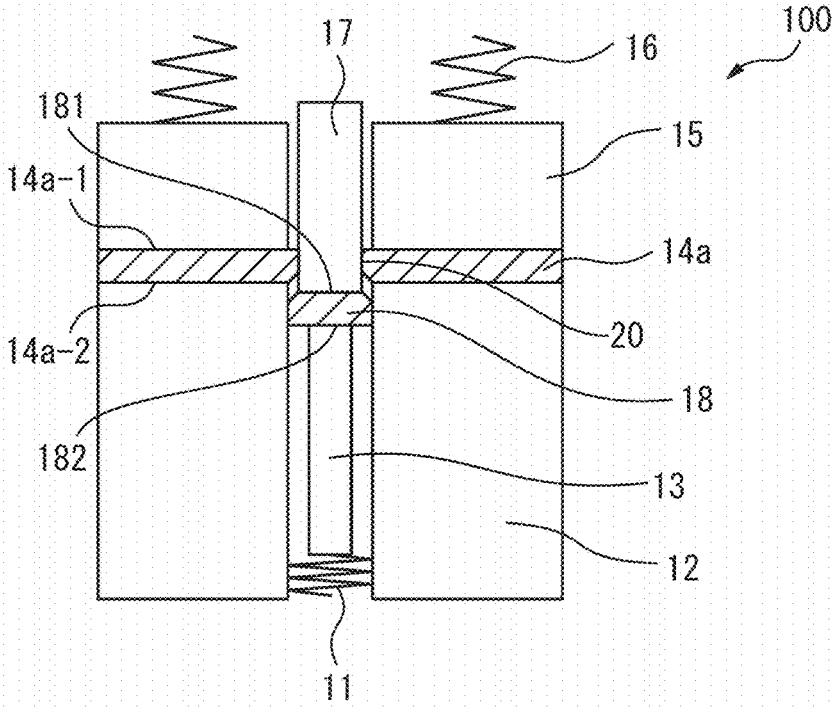
FIG. 6 is a cross-sectional schematic view showing a mode of further pushing in a punch to shear a workpiece.
Figure 7:
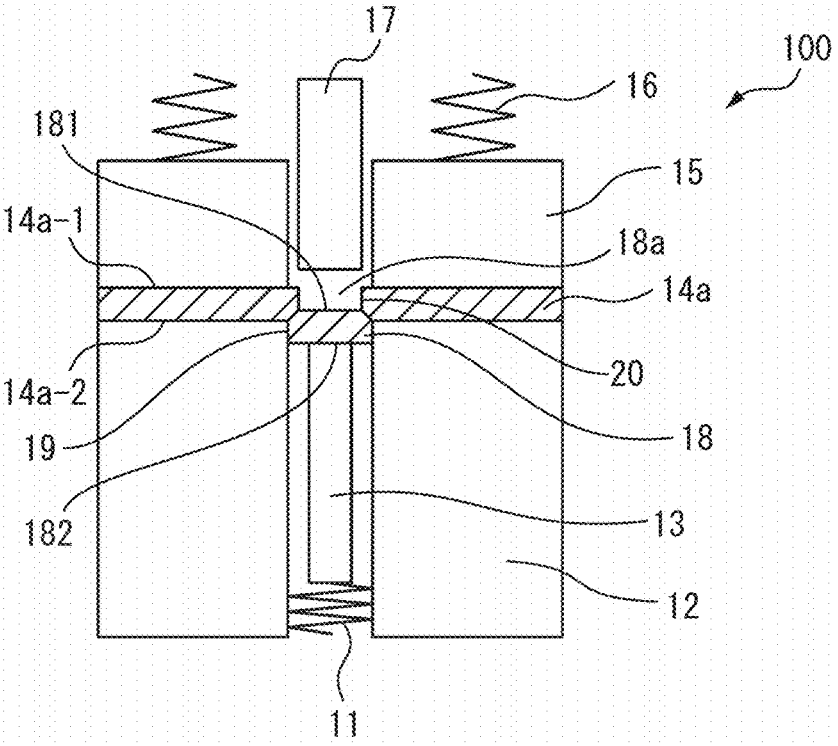
FIG. 7 is a cross-sectional schematic view showing a mode of pushing back a punched out material punched out by a punch in the state as punched so as to push the end face of the punched out material against the sheared edge of the worked material.

FIG. 3 is a cross-sectional schematic view of the mode of arrangement of a workpiece 14 having a first surface 141 and a second surface 142 at the opposite side at a shearing machine 100 which can be used in the method of the present disclosure. FIG. 4 is a cross-sectional schematic view of a mode of fastening the workpiece 14 at the shearing machine 100. FIG. 5 is a cross-sectional schematic view of a mode of making a punch 17 move from the first surface 141 to the second surface 142 of the workpiece 14 in the sheet thickness direction in the middle of shearing the workpiece 14. FIG. 6 is a cross-sectional schematic view of a mode of making the punch 17 further move to shear the workpiece 14. FIG. 7 is a cross-sectional schematic view of a mode of pushing back a punched out material 18 punched out by the punch in the state as punched to push it into the punched hole 18*a*.

As shown in FIG. 3, a workpiece 14 is arranged on the shearing machine 100. The shearing machine 100 is preferably provided with a pushing punch 13 held by an elastic member 11. The pushing punch 13 held by the elastic member 11 sticks out from the surface 121 of the die 12 contacting the second surface 142 of the workpiece 14 by exactly ΔH. ΔH can be changed in accordance with the amount by which the punched out material is pushed back. ΔH may be larger than the sheet thickness of the workpiece, may be the same as the sheet thickness of the workpiece, and may be zero. Further, the pushing punch 13 may be pulled in from the surface 121 of the die 12, but the amount by which it is pulled in is smaller than the sheet thickness of the workpiece. That is, ΔH may also be a minus value, but its magnitude (absolute value) is less than the sheet thickness. For example, if making ΔH larger than the sheet thickness of the workpiece, when pushing back the punched out material, the punched out material is made to push through the punched hole, while if making ΔH zero, the punched out material can be returned to the original position of the punched hole. The workpiece 14 is arranged at the shearing machine 100, then, as shown in FIG. 4, the elastic member 16 pushes against the holder 15 and fastens the workpiece 14 to the die 12.

Next, as shown in FIG. 5, in the state fastening the workpiece 14 at the die 12, the punch 17 is made to move from the first surface 141 toward the second surface 142 of the workpiece 14 in the sheet thickness direction and shear the workpiece 14. Furthermore, the punch 17 is made to move toward the second surface 142 to, as shown in FIG. 6, form the punched out material 18 and the worked material 14*a* having a sheared edge 20 including a burnished surface and fracture surface. The punched out material 18 has a first surface 181 and second surface 182 corresponding to the first surface 141 and second surface 142 of the workpiece 14. The worked material 14*a* has a first surface 14*a*-1 and second surface 14*a*-2 corresponding to the first surface 141 and second surface 142 of the workpiece 14.

The movement of the punch 17 from the first surface 141 toward the second surface 142 in the sheet thickness direction is preferably performed while applying back pressure from the pushing punch 13. By making the punch 17 move while countering the back pressure from the pushing punch 13, it is possible to hold the punched out material 18 more stably. The pushing punch 13 is not particularly limited so long as one able to shear the material, then push back the punched out material 18 in the state as punched out so as to push it into the punched hole 18*a*. In the present application, "in the state as punched out" and "in the state as punched" mean the same thing. They mean the state of the punched out material 18 obtained by shearing as is without detaching it from the die. The pushing punch 13 may stick out from the surface 121 of the die 12 or not stick out before arrangement of the workpiece 14. The method of driving the pushing punch 13 is not an issue if possible to drive the pushing punch 13. Instead of the elastic member, for example, it is also possible to use a gas cushion or cam mechanism for the operation.

Next, as shown in FIG. 7, the pushing punch 13 pushes the punched out material 18 in the state as punched into the punched hole 18*a* and pushes the end face 19 of the punched out material 18 against the contour surface of the punched hole 18*a*, that is, the sheared edge 20. When the pushing punch 13 is provided with an elastic member 11, it is possible to utilize the resilience of the elastic member 11 to make the pushing punch 13 push the punched out material 18 into the punched hole 18*a*. FIG. 7 shows the mode of stopping the pushing operation of the punched out material 18 before the second surface 182 of the punched out material 18 passes the position of the second surface 14*a*-2 of the worked material 14*a*.

Figure 2:
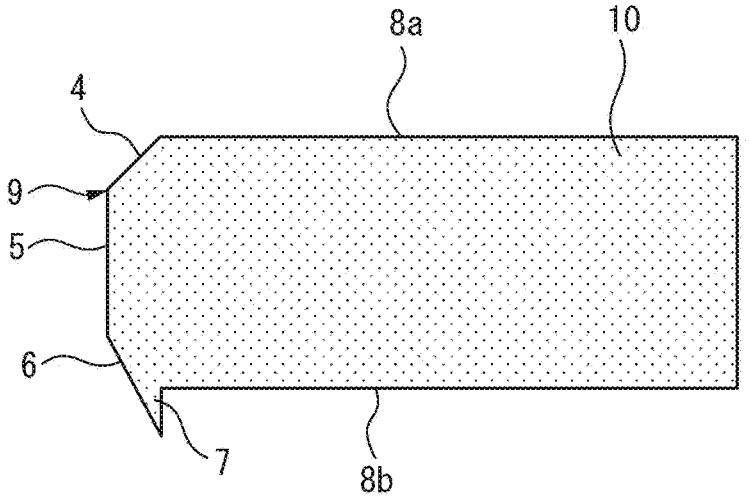
FIG. 2 is a cross-sectional schematic view of a sheared edge of the worked material.

The sheared edge 20 of the worked material 14*a*, as shown in FIG. 2, can be configured by a shear droop 4, burnished surface 5, fracture surface 6, and burr 7. In the method of the present disclosure, the punched out material 18 is used as a tool for finely adjusting the sheared edge 20 of the worked material 14*a*. The punched out material 18 is pushed into punched hole 18*a* to push the end face 19 of the punched out material 18 against the contour surface of the punched hole 18*a*, that is, the sheared edge 20. Due to this, it is possible to reduce the tensile residual stress at the sheared edge 20 of the worked material 14*a* and, preferably, possible to reduce the tensile residual stress while also reducing the variation. By reducing the tensile residual stress, it is possible to improve the hydrogen embrittlement resistance and fatigue strength.

Figure 8A:
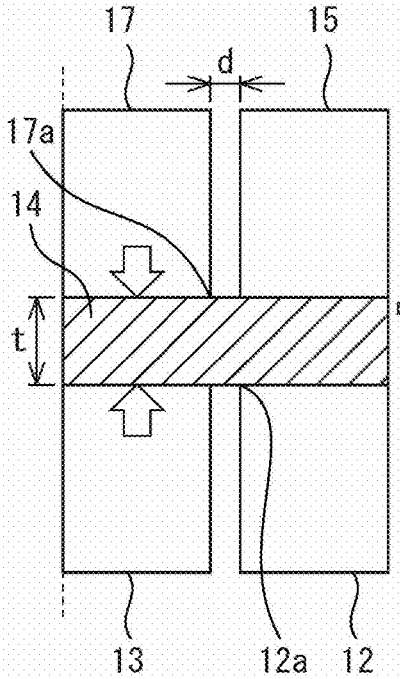
FIG. 8A is a cross-sectional schematic view of a clearance setting process.
Figure 8B:
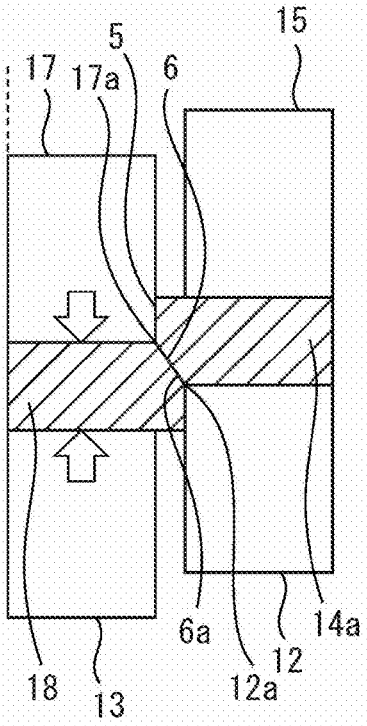
FIG. 8B is a cross-sectional schematic view of a shearing process.
Figure 8C:
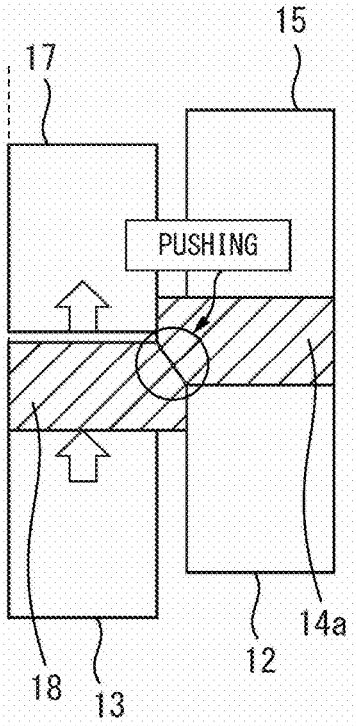
FIG. 8C is a cross-sectional schematic view of a pushing process.

FIGS. 8A to 8C are cross-sectional schematic views of one example of the clearance setting process, shearing process, and pushing process in the method of the present disclosure.

In the clearance setting process shown in FIG. 8A, the clearance "d" between the punch 17 and die 12 is set to a range of 5 to 80% of the sheet thickness "t" of the workpiece 14. Further, the workpiece 14 is fastened by the die 12 and holder 15.

In the shearing process shown in FIG. 8B, the punch 17 is used to shear the workpiece 14 whereby a punched out material 18 and a worked material 14*a* are obtained. The angle of the punch edge 17*a* (front end of punch 17) is preferably a right angle, but the punch edge 17*a* can be any shape within a range enabling shearing. For example, it may also have a rounded or chamfered part. The sheared edge of the worked material 14*a*, as shown in FIG. 2, can be configured by a shear droop 4, burnished surface 5, fracture surface 6, and burr 7. The end face 19 of the punched out material 18 can also be configured by a shear droop, burnished surface, fracture surface, and burr. The shape of the sheared edge 20 of the worked material 14*a* and the shape of the end face 19 of the punched out material 18 become substantially symmetrical shapes. FIG. 8B schematically shows only the burnished surface and fracture surface of the sheared edge of the worked material 14*a* and the end face 19 of the punched out material 18. The worked material 14*a* has a burnished surface 5 and fracture surface 6. The fracture surface 6 matches the fracture surface 6*a* of the punched out material 18 in angle. Furthermore, the clearance between the punched out material 18 and die 12 in a direction perpendicular to the sheet thickness of the worked material 14*a* is zero.

At the pushing process shown in FIG. 8C, the punched out material 18 in the state as punched out is pushed back in the state as punched out into the punched hole 18*a* to push the end face 19 of the punched out material 18 including the fracture surface 6*a* against the sheared edge of the worked material 14*a* including the fracture surface 6. Since the punched out material 18 having a fracture surface of the same shape as the fracture surface of the worked material and having zero clearance from the die 12 is pushed into the punched hole 18*a* in the state as punched out, the angles of the fracture surface 6 of the worked material 14*a* and the fracture surface 6*a* of the punched out material 18 match and it is possible to cause compressive plastic deformation at the surface layer as a whole of the fracture surface 6 of the worked material 14*a*. Preferably, the pushing punch 13 is used to push in the punched out material 18 while a load is being applied from the punch 17 to the punched out material 18. By using the pushing punch 13 to push in the punched out material 18 while applying a load from the punch 17 to the punched out material 18, at the time of the pushing operation, it is possible to keep the punched out material 18 from curving. If the curvature of the punched out material 18 is in an allowable range, as illustrated in FIG. 8C, it is also possible to use the pushing punch 13 to push in the punched out material 18 without applying a load from the punch 17 to the punched out material 18.

By making the clearance "d" 5 to 80% of the sheet thickness "t" of the workpiece 14, it is possible to increase the angle of the fracture surface of the sheared edge with respect to the direction of punch advance (sheet thickness direction). The angle θ of the fracture surface 6 of the worked material 14*a* with respect to the direction of punch advance (sheet thickness direction) is preferably 3° or more. The surfaces of the fracture surface 6 of the worked material 14*a* and the fracture surface 6*a* of the punched out material 18 which are pushed against each other have large angles with respect to the direction of punch advance (sheet thickness direction), so it is possible to cause compressive plastic deformation at the surface layer of the worked material.

Figure 9A:
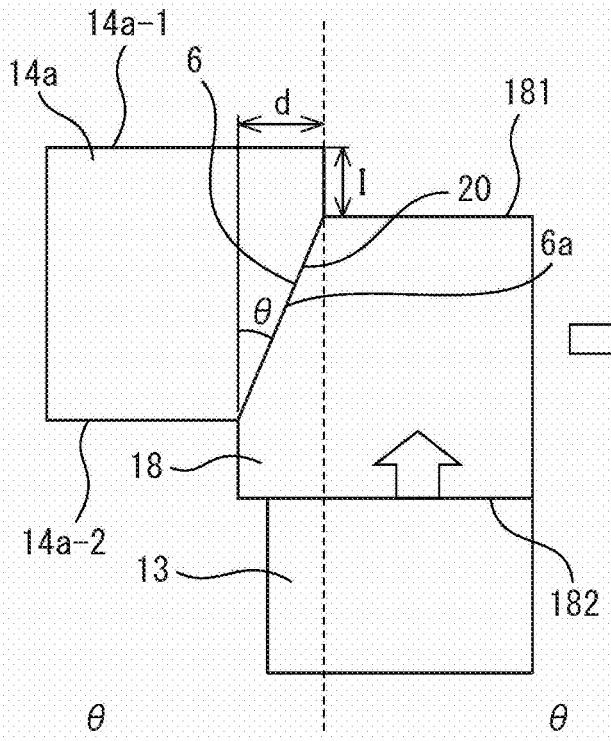
FIG. 9A is a cross-sectional schematic view showing a state when starting to push an end face of a punched out material against a sheared edge of a worked material.
Figure 9B:
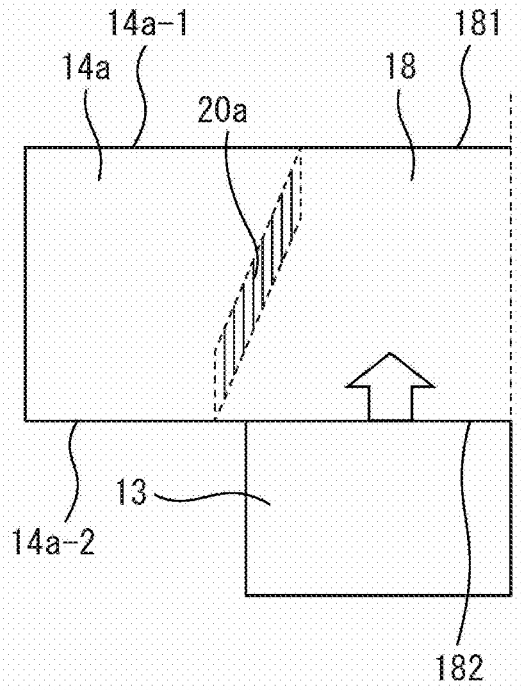
FIG. 9B is a cross-sectional schematic view showing a plastic forming region after finishing pushing an end face of a punched out material against a sheared edge of a worked material.

The reason why the pushing process reduces the tensile residual stress of the sheared edge of the worked material is believed to be as follows:

FIG. 9A and FIG. 9B are cross-sectional schematic views of the mode of pushing the end face 19 of the punched out material 18 against the sheared edge 20 of the worked material 14*a*. FIG. 9A is a cross-sectional schematic view at the time of start of a pushing operation when pushing the fracture surface 6*a* of the end face 19 of the punched out material 18 against the fracture surface 6 of the sheared edge 20 of the worked material 14*a*. FIG. 9B is a cross-sectional schematic view of the plastic forming region when finishing pushing the end face 19 of the punched out material 18 against the sheared edge 20 of the worked material 14*a*.

As shown in FIG. 9A, the pushing punch 13 is used to push the punched out material 18 in the punched hole 18*a* and push the fracture surface 6*a* of the punched out material 18 against the fracture surface 6 of the worked material 14*a*. In the method of the present disclosure, the angles θ of offset of the fracture surface 6 of the worked material 14*a* and the fracture surface 6*a* of the punched out material 18 with respect to the direction of punch advance are the same. For this reason, it is possible to stably cause the entire surface layer of the fracture surface 6 of the worked material 14*a* to plastically deform by compression. In the state as is, if the punched out material 18 is pushed back to the same position of the worked material 14*a* while pushing in the punched out material 18 to push the entire end face 19 of the punched out material 18 against the entire sheared edge 20 of the worked material 14*a*, an overlapping material region 20*a* is formed, as shown in FIG. 9B. For this reason, compressive plastic deformation occurs in the entire surface layer of the punched hole 18*a* of the worked material 14*a* and the tensile residual stress can be reduced. In FIG. 9B, the second surface 182 of the punched out material 18 is at the same position as the second surface 14*a*-2 of the worked material 14*a*. The first surface 181 of the punched out material 18 is also at substantially the same position as the first surface 14*a*-1 of the worked material 14*a*.

The larger the clearance "d" in a predetermined range, the greater the angles of offset θ of the fracture surface 6 of the worked material 14*a* and the fracture surface 6*a* of the punched out material 18 with respect to the direction of punch advance, so more possible it is to broaden the overlapping material region 20*a*. If enlarging the overlapping material region 20*a*, it is possible to increase the amount of reduction of the tensile residual stress. Therefore, it is preferable to increase the clearance "d" to an extent whereby no excessively large burr is formed.

The lower limit of the clearance "d" is 5% or more of the sheet thickness of the workpiece 14, preferably 10% or more, more preferably 15% or more, still more preferably 20% or more. The upper limit of the clearance "d" is 80% or less, preferably 60% or less, more preferably 50% or less, still more preferably 40% or less, even more preferably 30% or less. By making the clearance "d" within the above range, it is possible to increase the angle θ of the fracture surface 6 of the sheared edge with respect to the direction of punch advance without causing the formation of an excessively large burr.

If the clearance "d" is less than 5%, the punched hole and fracture surface of the punched out material cannot be given sufficient angles with respect to the direction of punch advance (sheet thickness direction). It is not possible to apply a force causing compressive plastic deformation at the fracture surface of the sheared edge. Further, if the clearance "d" is less than 5%, a secondary burnished surface is easily formed at the sheared edge of the worked material and sometimes locally the punched hole and the punched out material will catch and the pushing operation cannot be sufficiently performed. If the clearance "d" exceeds 80%, the shearing operation cannot be performed. If the clearance "d" is 80% or more, ironing occurs, while if the clearance "d" is 100% or more, the result is a bending or drawing operation.

In particular, with a clearance "d" of 5 to 30% in range, it is possible to make the angle θ of the fracture surface 6 larger and possible to obtain a great pushing effect. Even with a clearance "d" of over 30% to 80% in range, it is possible to obtain a pushing effect. However, with a clearance "d" of over 30% in range, a crack during shearing progresses offset from the punch edge 17*a* to the direction of punch advance side, the angle θ of the fracture surface is decreased, and a large burr sometimes forms at the sheared edge of the worked material. With a clearance "d" of over 60% in range, sometimes the shear droop at the sheared edge becomes larger, the direction of progression of the crack becomes further offset in the direction of punch advance, and the angle θ of the fracture surface decreases.

A burr can be formed at the second surface side of the sheared edge of the worked material by fracture due to a crack formed from the punch edge 17*a* forming not in the direction of the die edge 12*a* but offset from the direction of punch advance. As the clearance "d" becomes larger exceeding 30%, the burr which is formed at the second surface side of the sheared edge can become larger. If an excessively large burr is formed, sometimes the angle θ of offset of the fracture surface 6 of the worked material 14*a* and the fracture surface 6*a* of the punched out material 18 from the direction of punch advance becomes smaller. Further, the stretch flangeability also can fall. Therefore, it is preferable to set the clearance "d" so as to avoid formation of an excessively large burr.

In the method of the present disclosure, the punched out material 18 is used in a state as punched out as a tool for finely adjusting the sheared edge of the worked material 14*a*. The angle θ of the fracture surface 6*a* of the punched out material 18 with respect to the direction of punch advance becomes the same as the angle θ of the fracture surface 6 of the sheared edge with respect to the direction of punch advance. Therefore, the larger the angle of the fracture surface 6 of the sheared edge with respect to the direction of punch advance, the more sufficiently it is possible to obtain a force by which the fracture surface 6*a* of the punched out material 18 pushes against the fracture surface 6 of the worked material 14*a* and the more stably it is possible to cause compressive plastic deformation at the entire surface layer of the fracture surface 6 of the worked material 14*a*.

The angle θ of the fracture surface 6 of the sheared edge is preferably 3° or more with respect to the direction of punch advance, more preferably 5.5° or more, still more preferably 11° or more. By making the angle θ of the fracture surface 6 of the sheared edge 20 within the above range, it is possible to more stably cause compressive plastic deformation at the entire surface layer of the fracture surface 6 of the sheared edge. The fracture surface can become the largest in tensile residual stress in the sheared edge. Therefore, the fracture surface easily becomes the most problematic in terms of the hydrogen embrittlement resistance and fatigue strength. For this reason, preferably the tensile residual stress of the entire surface layer of the fracture surface is reduced, more preferably the tensile residual stress of the entire surface layers of the fracture surface and burnished surface is reduced, still more preferably the tensile residual stress of the entire surface layer of sheared edge is reduced.

In the present application, "push against the sheared edge" means at least pushing the fracture surface of the punched out material against the fracture surface of the sheared edge. After pushing the fracture surface of the punched out material against the fracture surface of the sheared edge, it is possible to stop the pushing operation of the punched out material at that point of time. It is also possible to push in the punched out material and make the punched out material pass through the punched hole.

In the pushing process, when pushing back the punched out material 18 into the punched hole 18*a*, the punched out material 18 may be pushed in to make the punched out material 18 pass through the punched hole 18. However, from the viewpoint of coining the sheared edge 20 and improving the stretch flangeability, it is preferable to push in the punched out material 18 to an extent where the second surface 182 of the punched out material 18 does not pass through the first surface 14*a*-1 of the worked material 14*a*.

By pushing in the punched out material 18 to an extent where the second surface 182 of the punched out material 18 does not pass through the first surface 14*a*-1 of the worked material 14*a*, it is possible to coin the sheared edge of the worked material 14*a* and possible to obtain excellent stretch flangeability. Therefore, in addition to excellent hydrogen embrittlement resistance and fatigue strength, it is also possible to simultaneously obtain excellent stretch flangeability. If pushing in the punched out material 18 up to a position where the second surface 182 of the punched out material 18 passes through the first surface 14*a*-1 of the worked material 14*a*, shaving scraps are generated, a burr is formed at the first surface 14*a*-1 side of the worked material 14*a*, and additional work hardening is caused. For this reason, the stretch flangeability of the sheared edge 20 of the worked material 14*a* falls.

More preferably, the punched out material 18 is pushed by a range where the second surface 182 of the punched out material 18 does not pass the position of half of the sheet thickness from the second surface 14*a*-2 of the worked material 14*a* toward the first surface 14*a*-1. By pushing the punched out material 18 in this range, it is possible to coin the entire sheared edge of the worked material and possible to suitably lighten the compressive plastic deformation and stop at exactly the surface layer part of the sheared edge, so it is possible to obtain more excellent stretch flangeability.

Still more preferably, the punched out material 18 is pushed in so that the position of the second surface 182 of the punched out material 18 becomes substantially the same as the position of the second surface 14*a*-2 of the worked material 14*a*. At this time, the position of the first surface 181 of the punched out material 18 becomes substantially the same as the position of the first surface 14*a*-1 of the worked material 14*a*. The punched out material 18 is returned to the original position in the punched hole 18*a*, the entire sheared edge of the worked material can be coined, and the compressive plastic deformation can be lightened more suitably and be stopped at exactly the surface layer part of the sheared edge, so more excellent stretch flangeability can be obtained.

So long as the fracture surface 6*a* of the punched out material is pushed against the fracture surface 6 of the worked material 14*a*, the punched out material 18 can be pushed by a range where the second surface 182 of the punched out material 18 does not pass the position of the second surface 14*a*-2 of the worked material 14*a*. In this case, the coining operation of the sheared edge of the worked material can be stopped at the region of part of the sheared edge, but if the surface layer of the fracture surface 6 is coined, it is possible to obtain the effect of improvement of the surface properties of the sheared edge.

By pushing the punched out material 18 by a range where the second surface 182 of the punched out material 18 does not pass the first surface of the worked material 14*a*, it is possible to suppress work hardening accompanying shaving to improve the stretch flangeability and possible to obtain a steel material having a sheared edge excellent in hydrogen embrittlement resistance, fatigue strength, and stretch flangeability.

In the present application, "coining" means applying compressive stress to the sheared edge of the worked material to improve the surface conditions and shape of the sheared edge and is clearly differentiated from so-called "shaving" which cuts the surface of the sheared edge.

"Shaving" means slightly shearing the sheared edge of the worked material, that is, slightly cutting it. In the present application, coining does not cause the material to be separated. If the material becomes separated, the operation is deemed as shaving.

It is possible to take out the punched out material 18 and the worked material 14*a* from the shearing machine by any method. For example, it is possible to make the holder 15 rise from the state shown in FIG. 7 and then take out the punched out material 18 and the worked material 14*a*.

The punched out material 18 pushed into the punched hole 18*a* may be pushed out by the punch 17 then the punched out material 18 may again be pushed into the punched hole 18*a*. Further, this may be repeated. By repeatedly pushing the punched out material 18 into the punched hole 18*a*, it is possible to further reduce the tensile residual stress of the sheared edge and improve the hydrogen embrittlement resistance and fatigue strength more. Further, at the sheared edge 20 of the worked material 14*a*, the burnished surface and fracture surface become respectively smoother in roughnesses than visually apparent.

The punched shape of the punched out material may be made a circular shape, elliptical shape, polygonal shape, asymmetric shape, or other desired shape so long as the shearing process and pushing process in the method of the present disclosure can be performed.

The method of the present disclosure exhibits the effect of improvement of the surface properties of the sheared edge of the worked material in the same way even in a shearing operation forming an open section (sheared edge) in the workpiece such as shown in FIG. 1B. This will be explained below.

FIG. 10 to FIG. 13 are cross-sectional schematic views of modes of using a cantilever type shearing machine to shear a workpiece and push the punched out material in the state as punched out to push the end face of the punched out material against the sheared edge of the worked material.

Figure 10:
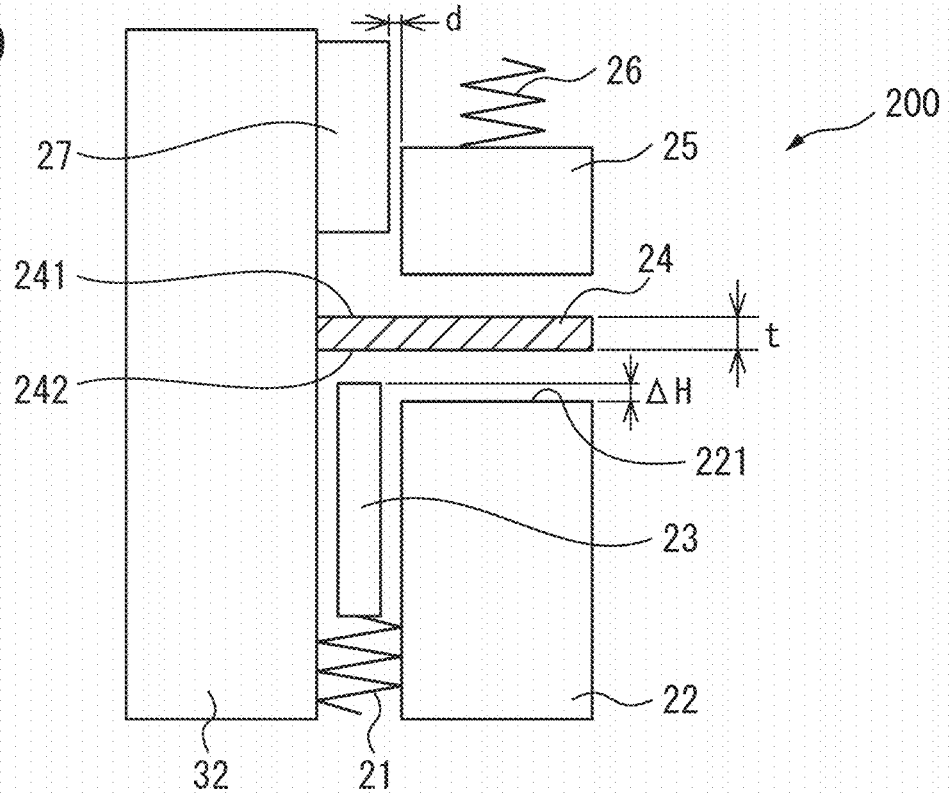
FIG. 10 is a cross-sectional schematic view showing a mode of arranging a workpiece at a cantilever type shearing machine.
Figure 11:
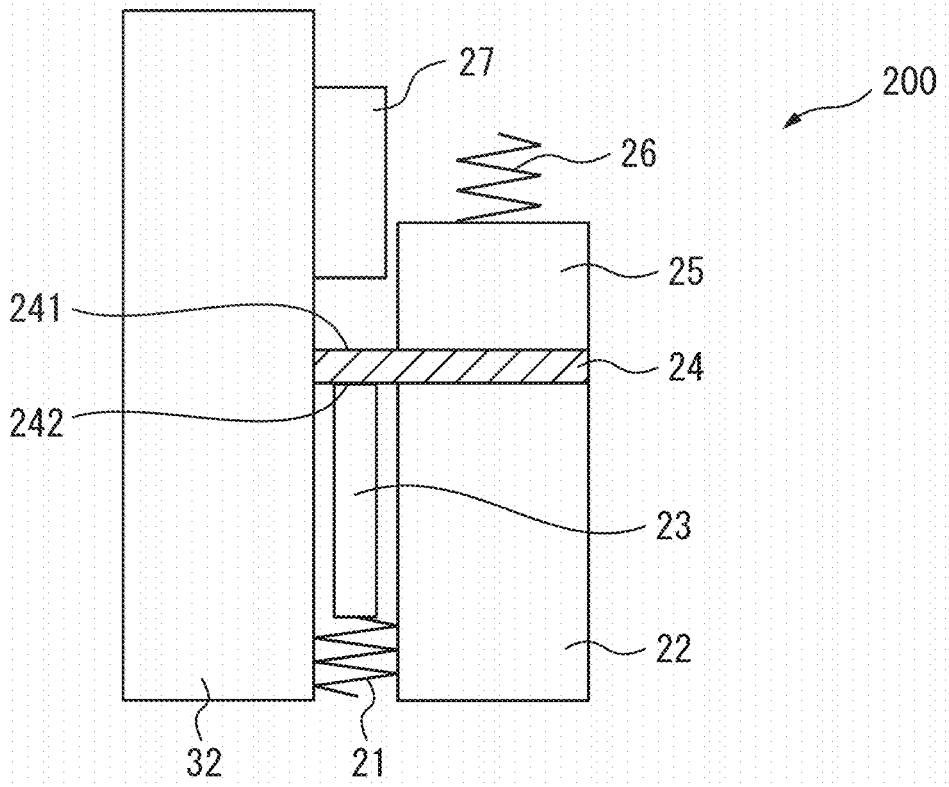
FIG. 11 is a cross-sectional schematic view showing a mode of fastening a workpiece at a cantilever type shearing machine.
Figure 12:
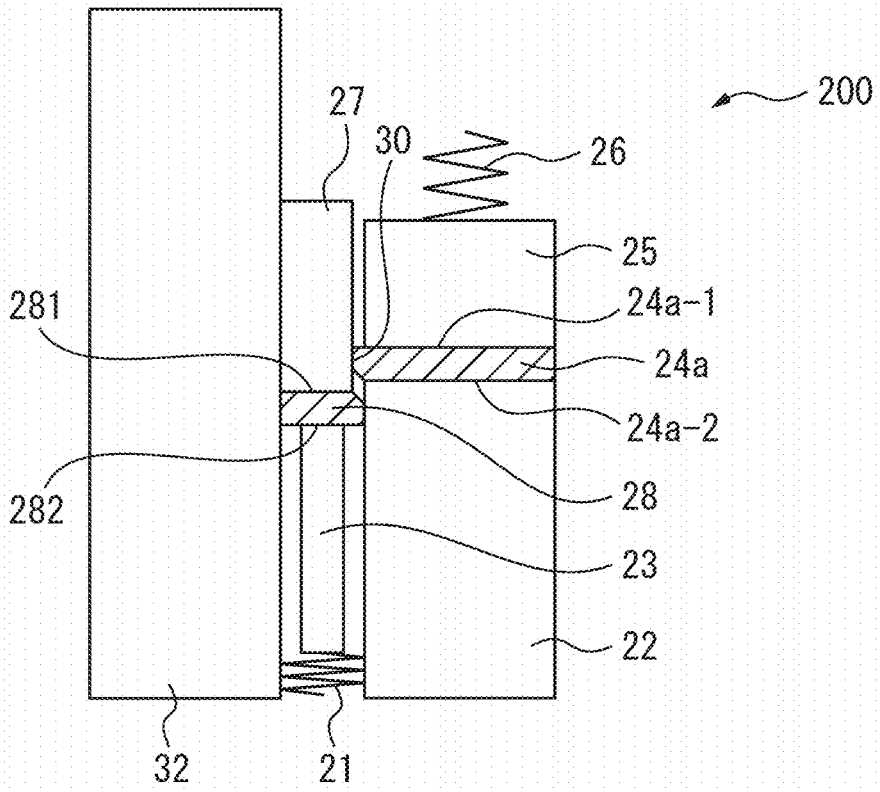
FIG. 12 is a cross-sectional schematic view showing a mode of pushing in a punch to shear a workpiece.
Figure 13:
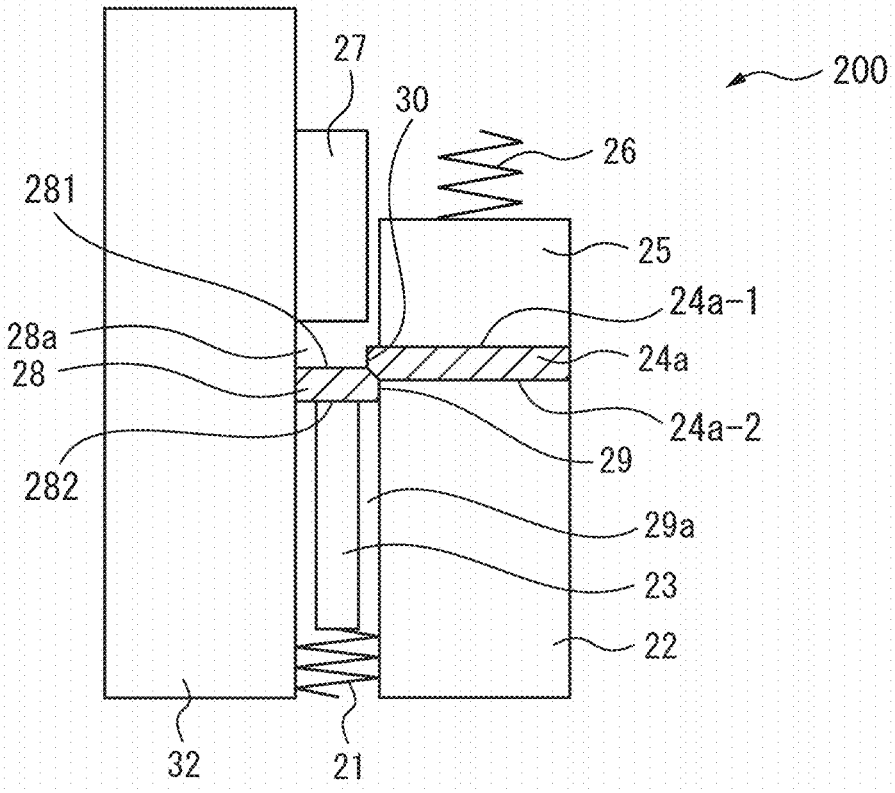
FIG. 13 is a cross-sectional schematic view showing a mode of pushing back a punched out material punched by a punch in the state as punched and pushing the end faces of the punched out material against the sheared edge of the worked material.

FIG. 10 is a cross-sectional schematic view of a mode of arrangement of the workpiece 24 at the cantilever type shearing machine 200. FIG. 11 is a cross-sectional schematic view of a mode of fastening the workpiece 24 at the cantilever type shearing machine 200. FIG. 12 is a cross-sectional schematic view of a mode of pushing in a punch 27 to shear the workpiece 24. FIG. 13 is a cross-sectional schematic view of a mode of pushing back the punched out material 28 punched out by the punch 27 in the state as punched and pushing the end face 29 of the punched out material 28 against the sheared edge 30 of the worked material 24*a*.

As shown in FIG. 10, a workpiece 24 is arranged at a cantilever type shearing machine 200 where a pushing punch 23 held by an elastic member 21 at one side of the machine foil 32 sticks out by exactly ΔH from the surface 221 of the die 22. As shown in FIG. 11, the elastic member 26 pushes against the holder 25 and fastens the workpiece 24 to the die 22 of the shearing machine. Next, as shown in FIG. 12, in the state fastening the workpiece 24 at the die 22 of the shearing machine, the punch 27 is made to move from the first surface 241 toward the second surface 242 of the workpiece 24 in the sheet thickness direction, performs the shearing operation of the workpiece 24, and forms a punched out material 28 and a worked material 24*a* having a sheared edge including a burnished surface and fracture surface. The movement of the punch 27 from the first surface 241 toward the second surface 242 in the sheet thickness direction is preferably performed while applying back pressure from the pushing punch 23. The pushing punch 23 is not particularly limited so long as one able to push back the punched out material 28 in the state as punched after shearing and able to push it into the punched hole 28*a*. The pushing punch 23 may stick out from the surface 221 of the die 22 contacting the second surface 242 of the workpiece 24 or not stick out before arrangement of the workpiece 24. The method of driving the pushing punch 13 is not an issue if possible to drive the pushing punch 23. Instead of the elastic member, for example, it is also possible to use a gas cushion or cam mechanism for the operation.

Next, as shown in FIG. 13, the resilience of the elastic member 21 is used to make the pushing punch 23 push back the punched out material 28 in the state as punched to push it into the punched hole 18*a* and push the end face 29 of the punched out material 28 against the sheared edge 30 of the contour surface of the punched hole 28*a*.

Even in the case of performing a cantilever type shearing operation, for a similar reason to the case of performing the shearing operation illustrated in FIGS. 3 to 7, it is also possible to push in the punched out material 28 to make the punched out material 28 pass through the punched hole 28*a*, but the pushing operation of the punched out material 28 preferably is performed in the range where the second surface 282 of the punched out material 28 does not pass the first surface 24*a*-1 of the worked material 24*a*, more preferably is performed in the range where it does not pass the position of half of the sheet thickness from the second surface 24*a*-2 toward the first surface 24*a*-1 of the worked material 24*a*. Preferably, it is performed so that the position of the second surface 282 of the punched out material 28 becomes substantially the same as the position of the second surface 24*a*-2 of the worked material 24*a*. Further, the pushing operation of the punched out material 28 may also be performed in a range where the second surface 282 of the punched out material 28 does not pass the position of the second surface 24*a*-2 of the worked material 24*a*.

In the method of the present disclosure, even if using a cantilever type shearing machine 100, the tensile residual stress decreases at the sheared edge and the hydrogen embrittlement resistance and fatigue strength are improved, the stretch flangeability can also be improved, and the burnished surface and fracture surface become respectively smoother in roughnesses than visually apparent as previously explained.

To take out the punched out material 28 and the worked material 24*a* from the cantilever type shearing machine 200, for example, it is sufficient to push in the punch 27 to push the punched out material 28 to the second surface 24*a*-2 side of the worked material 24*a* from the state shown in FIG. 13.

Even if using a cantilever type shearing machine to work the method of the present disclosure, the punched shape of the punched out material may be made a circular shape, elliptical shape, polygonal shape, asymmetric shape, or other desired shape so long as the shearing process and pushing process in the method of the present disclosure can be performed.

Even if using a cantilever type shearing machine to work the method of the present disclosure, there is no limit to the number of times the operation of pushing the punched out material into the punched hole and then pushing it out may be repeated. The number of times may be set considering the degree of improvement of the surface properties of the sheared edge and the productivity.

The method of the present disclosure can be used even in the case of performing an outer trimming operation. In the present application, "outer trimming" means punching the outer circumferential side (outer circumferential part) of the workpiece and obtaining the worked material of the inner circumferential side (inner circumferential part) as a final product. Outer trimming is particularly effective when requiring a product of a large surface area such as steel sheet for automotive use. It can also be applied even when the final product is large in area and asymmetric.

For performing an outer trimming operation, the die, punch, and pushing punch can be provided in an outer trimming type configuration where the die is arranged at the inner circumferential side of the workpiece and the punch and pushing punch are arranged at the outer circumferential side of the workpiece. The punch and pushing punch are arranged so as to straddle the workpiece.

At the outer trimming operation, when punching the outer circumferential part of the workpiece by a punch, it is necessary to constrain the outer circumferential part so that the outer circumferential part does not escape to the outside. As the method for constraining the outer circumferential part, the following methods may be mentioned:

(First Embodiment of Outer Trimming)

At least one of a punching surface of a punch and pushing surface of a pushing punch may have projecting parts, and the shearing operation and pushing operation may be conducted while the punch and pushing punch are clamping and fastening the workpiece between them.

Figure 14:
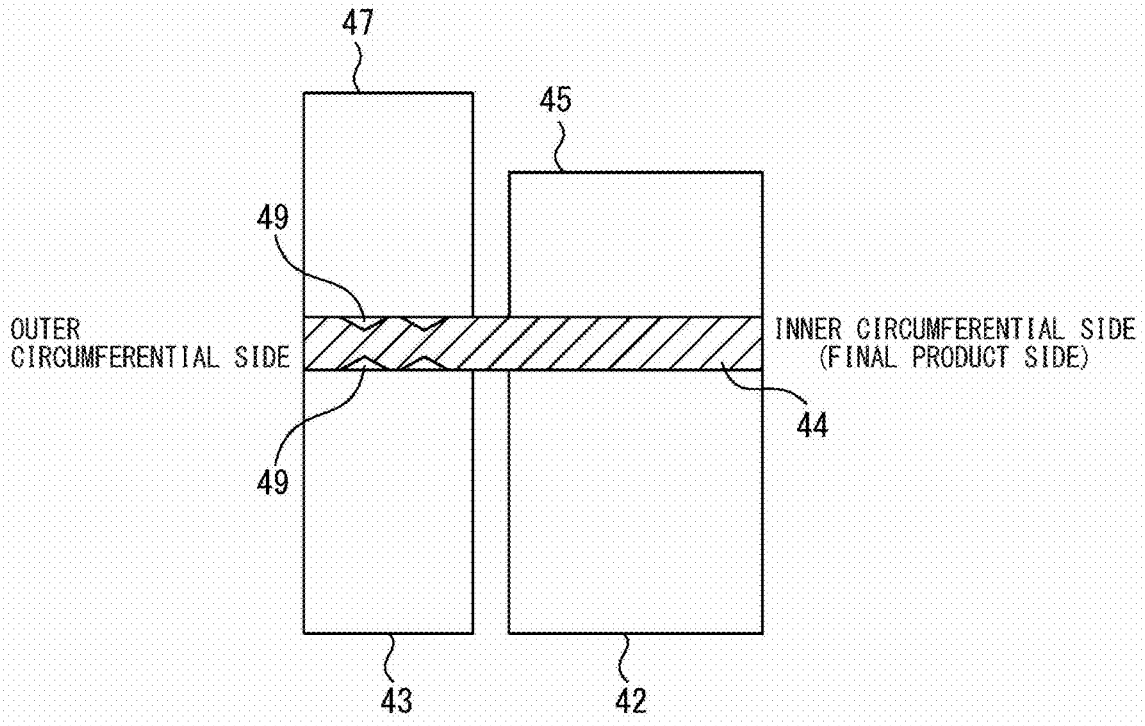
FIG. 14 is a cross-sectional schematic view for explaining a first embodiment of outer trimming.

FIG. 14 shows an example of a mode of constraining a workpiece 44 by providing projecting parts 49 at the punching surface of the punch 47 and the pushing surface of the pushing punch 43. In this mode, it is possible to perform punching as is. If providing projecting parts at only one of the punch 47 and pushing punch 43, the outer circumference of the workpiece 44 is fastened by the punch 47 and pushing punch 43, so there is no need for a new part and it is not necessary to increase the scrap.

(Second Embodiment of Outer Trimming)

It is possible to arrange an additional punch linked with a punch at a further outer circumferential side from a punch and arrange an additional pushing punch linked with a pushing punch at a further outer circumferential side of a pushing punch. At least one of the punching surface of the additional punch and the pushing surface of the additional pushing punch can have projecting parts 49, and the shearing operation and the pushing operation can be conducted while the punched surfaces of the linked punch and additional punch and the pushing surfaces of the linked pushing punch and additional pushing punch are gripping and fastening the outer circumference part of the workpiece. The additional pushing punch and pushing punch can be linked by embedding metal pins in the two. Note that, the linkage method is not limited to this method. The method is not an issue if the predetermined linkage strength is secured.

Figure 15:
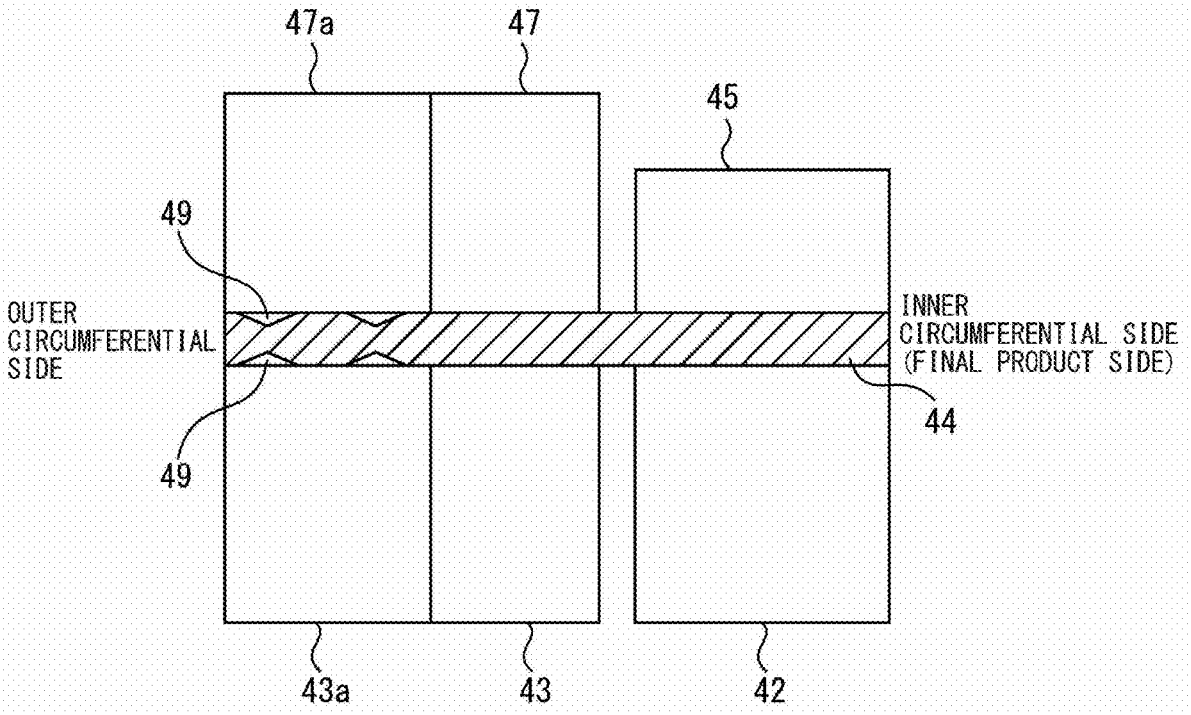
FIG. 15 is a cross-sectional schematic view for explaining a second embodiment of outer trimming.

FIG. 15 shows an example of a mode of linking the additional punch 47*a* with the outer circumferential side of the punch 47, linking the additional pushing punch 43*a* with the outer circumferential side of the pushing punch 43, and providing projecting parts 49 at the punching surface of the additional punch 47*a* and the pushing surface of the pushing punch 43*a* to constrain the workpiece 44. In this mode, it is possible to perform a punching operation as is. Even if the additional punch 47*a* and additional pushing punch 43*a* formed with the projecting parts become worn, the additional punch and additional pushing punch are easy to replace.

(Third Embodiment of Outer Trimming)

It is possible to arrange an additional holder at a further outer circumferential side from a punch and arrange an additional die facing the additional holder across a workpiece at the further outer circumferential side from a pushing punch. The fastening surface of at least one of the additional holder and additional die facing the first surface and second surface of the workpiece can have projecting parts. The shearing operation and pushing operation can be conducted while the fastening surface of the additional holder and the fastening surface of the additional die are gripping and fastening the outer circumferential part of the workpiece.

Figure 16:
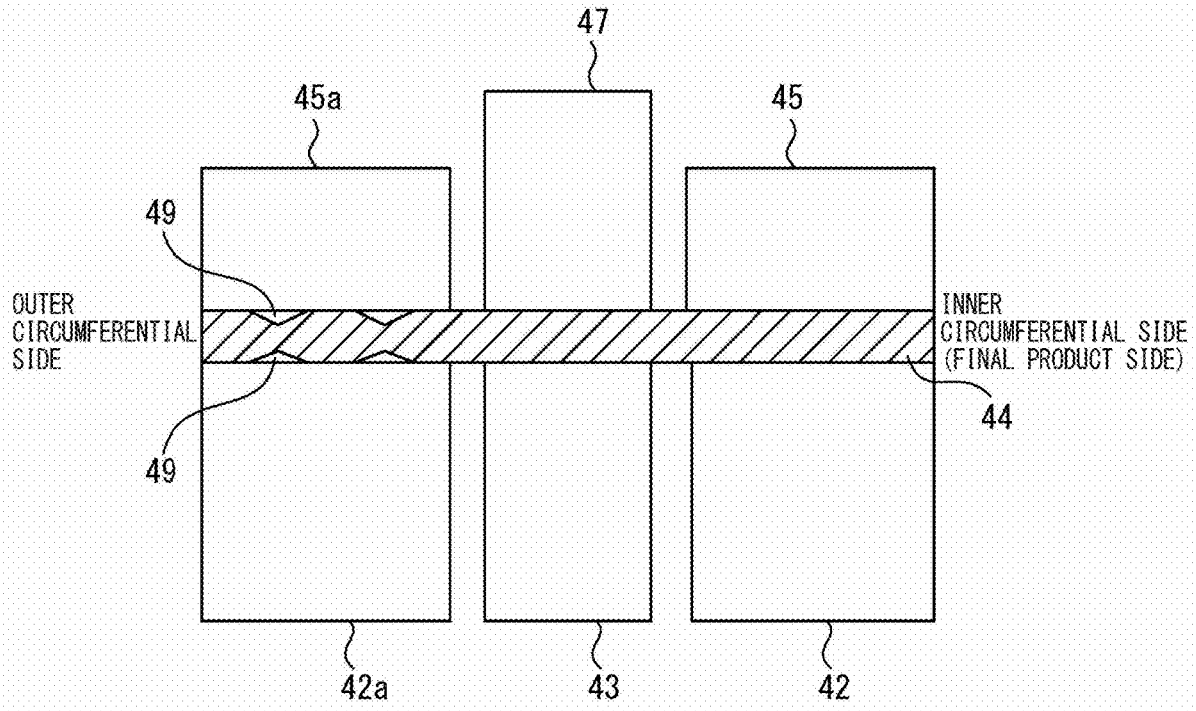
FIG. 16 is a cross-sectional schematic view for explaining a third embodiment of outer trimming.

FIG. 16 is a cross-sectional schematic view of a mode of constraining the outer circumferential part of the workpiece 44 by an additional holder 45*a* and additional die 42*a* provided with projecting parts at the fastening surfaces. In FIG. 16, at the outer circumferential sides of the punch 47 and pushing punch 43, an additional holder 45*a* and additional die 42*a* provided with projecting parts 49 at the surfaces fastening the outer circumferential part of the workpiece 44 are arranged. It is possible to constrain the workpiece 44 using not only the holder 45 and die 42, but also the additional holder 45*a* and additional die 42*a* having the projecting parts 49. In this way, it is possible to use the punch 47 for the shearing operation and use the pushing punch 43 for the pushing operation while the workpiece 44 is being constrained.

The projecting parts may be any shapes enabling the workpiece to be constrained. They may be projections, relief shapes, surface treated surfaces, or other shapes raising the frictional resistance. The projections may be formed by embedding pins having projecting shapes at their front ends. The relief shapes can be formed by cutting the surfaces contacting the steel sheet to form depth 10 μm to 500 μm grooves. The surface treatment can be performed by sandblasting or another method increasing the frictional resistance.

The height of the projecting parts provided at the surface fastening the outer circumferential part of the workpiece in the direction perpendicular to the surface is preferably 10 to 500 μm. The circle equivalent diameter of the projecting parts is preferably 10 to 500 μm. The higher the height of the projecting parts in the direction perpendicular to the constrained surface of the workpiece, the stronger the constraining force can be made, but the wear at the projecting parts easily becomes larger. Further, the load required for biting into the workpiece rises. The smaller the circle equivalent diameter of the projecting parts, the more possible it is to bite into the workpiece with a small load, but the easier it becomes for the wear of the projecting parts to increase. The smaller the number of projecting parts (density), the more possible it is to bite into the workpiece with a small load, but the constraining force is weakened.

The fastening surface of at least one of the holder and die fastening the inner circumferential part forming the final product may be provided with projecting parts. It is possible for the projecting parts to deform the surface of the product, so this mode is limited to the case where the quality of the final product is acceptable even if deformation is caused by the projecting parts.

When the strength of the workpiece is high, the load of the punch becomes larger by that amount, so the workpiece more easily escapes to the outer circumferential side. For this reason, when using a die and holder to constrain a workpiece, it is necessary to further raise the constraining load. Even if using a punch having projecting parts to constrain a workpiece, constraint easily becomes insufficient. Further, if the strength of the workpiece becomes higher, the projecting parts become easy to crush.

When the strength of the workpiece is high, it is effective to perform the shearing operation at a desired position of the outer circumferential side of the workpiece in advance to form a sheared edge at the end part of the workpiece and constrain the sheared edge formed at the end part to perform the above shearing operation and pushing operation on the workpiece. This method is particularly effective when the strength of the workpiece is the 980 MPa class or more. At the sheared edge formed at the end part, the quality of the surface properties is not particularly a problem so long as of an extent enabling constraint.

(Fourth Embodiment of Outer Trimming)

Figure 17B:
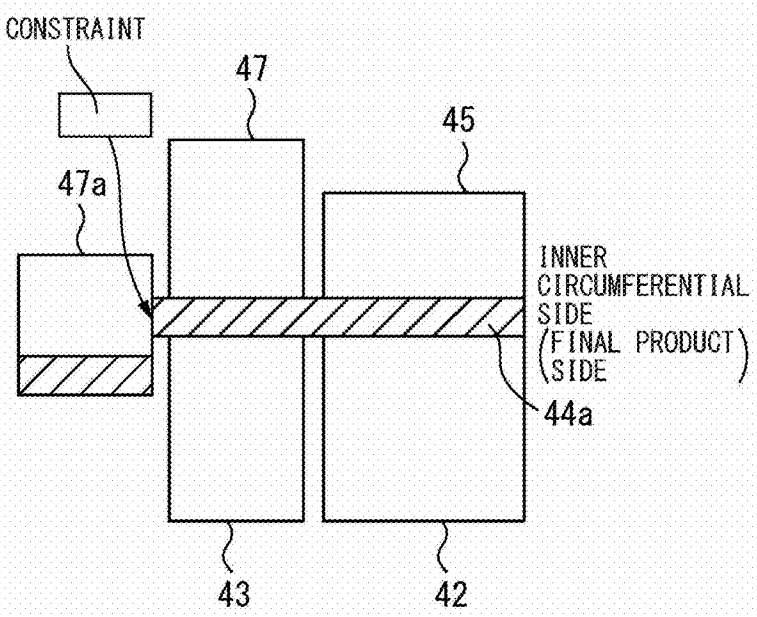
FIG. 17A and FIG. 17B are cross-sectional schematic views for explaining a fourth embodiment of outer trimming.
Figure 17A:
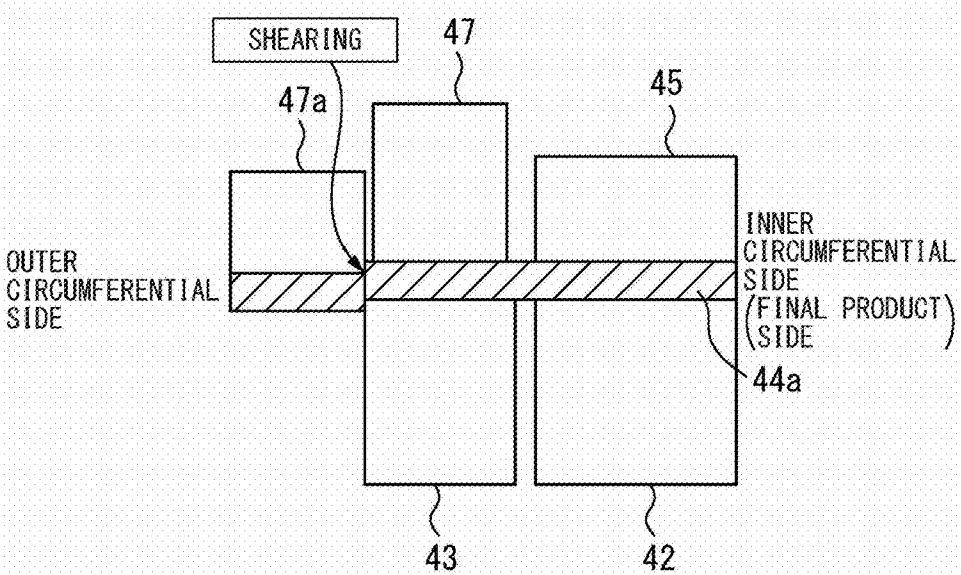

FIG. 17A is a cross-sectional schematic view of a mode where shearing is performed at a desired position at an outer circumferential side of a workpiece in advance so as to obtain a sheared edge for constraint. In FIG. 17A, an additional punch 47*a* is arranged at the outer circumferential side of the punch 47. First, it is possible to shear the workpiece between the additional punch 47*a* and pushing punch 43. In this embodiment, the pushing punch 43 has to be fastened.

FIG. 17B is a cross-sectional schematic view of the mode where the left end of the sheared edge of the sheared workpiece is constrained by a side surface of the additional punch 47*a*. Since the left end of the workpiece is constrained by a side surface of the additional punch 47*a*, it is possible to use the punch 47 and die 42 to set the clearance and perform the shearing operation and the pushing operation of the processes (A) to (C) while keeping the workpiece from escaping to the outer circumferential side.

(Fifth Embodiment of Outer Trimming)

Figure 18B:
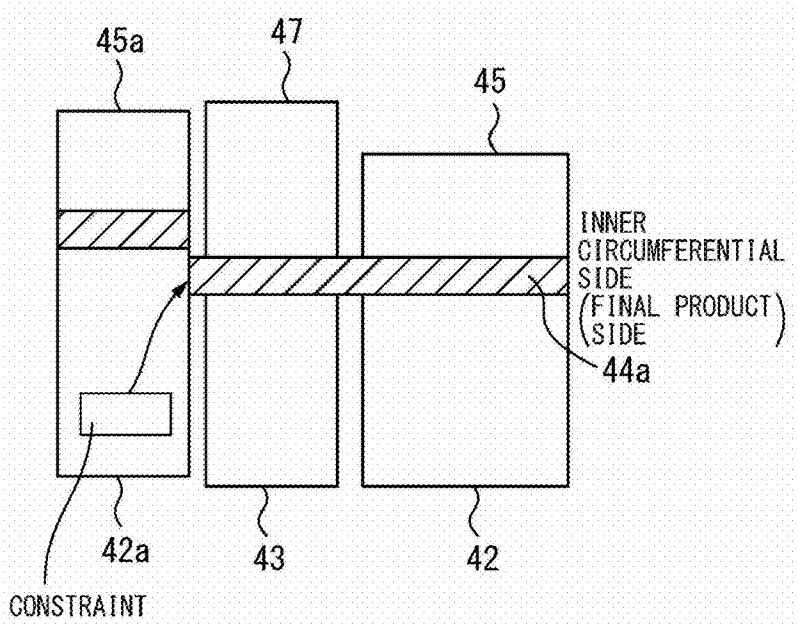
FIG. 18A and FIG. 18B are cross-sectional schematic views for explaining a fifth embodiment of outer trimming.
Figure 18A:
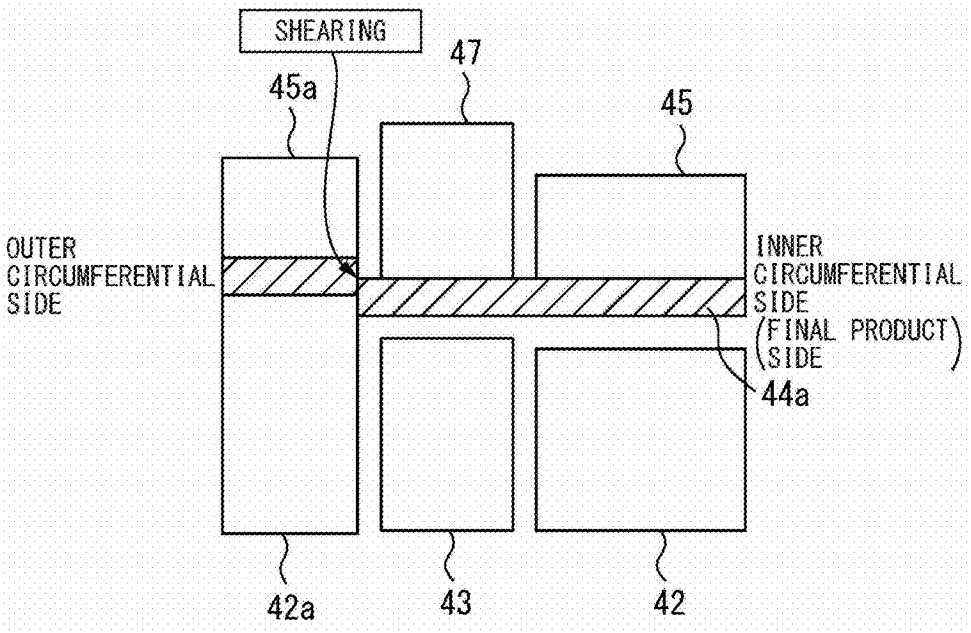

FIG. 18A is a cross-sectional schematic view of a mode of shearing at a desired position of an outer circumferential side of a workpiece in advance so as to obtain a sheared edge for constraint use. In FIG. 18A, an additional holder 45*a* and additional die 42*a* are arranged at the outer circumferential sides of the punch 47 and pushing punch 43 across the workpiece. First, the workpiece can be sheared between the punch 47 and the additional die 42*a*.

It is possible to arrange the die 42*a* so that the fastening surface of the die 42*a* for fastening the workpiece is positioned at a higher position, same position, or lower position than the position of the fastening surface of the die 42 in the thickness direction of the workpiece and shear the workpiece between the punch 47 and additional die 42*a*.

When arranging the additional die 42*a* so that the fastening surface of the additional die 42*a* becomes a higher position than the fastening surface of the die 42, the deviation of the position of the fastening surface of the die 42*a* with respect to the position of the fastening surface of the die 42 in the thickness direction of the workpiece is preferably 3 times or less of the sheet thickness of the workpiece, more preferably 2 times or less. It may also be the sheet thickness or less or ½ of the sheet thickness or less. By making the deviation the above range, it is possible to suppress, that is, prevent, curvature of the workpiece at the time of shearing.

If arranging the additional die 42*a* so that the fastening surface of the additional die 42*a* becomes the same position or a lower position than the fastening surface of the die 42, the deviation of the position of the fastening surface of the die 42*a* from the position of the fastening surface of the die 42 in the thickness direction of the workpiece is less than the sheet thickness of the workpiece. By making the deviation less than the sheet thickness of the workpiece, it is possible to constrain the left end of the worked material by a side surface of the additional die 42*a*.

As another method, the fastening surface for fastening the workpiece of the die 42*a* and the fastening surface of the die 42 may be arranged to become the same position, the additional die 42*a* and additional holder 45*a* may be fastened to make the holder 45 and die 42 and the punch 47 and pushing punch 43 simultaneously operate, and the workpiece may be sheared between the punch 47 and additional die 42*a*. To enable simultaneous operation, the holder 45 and punch 47 may be linked and the die 42 and punch 43 may be linked.

FIG. 18B is a cross-sectional schematic view of the mode where the left end of the sheared workpiece is constrained by a side surface of the additional die 42*a*. Since the left end of the workpiece is constrained by a side surface of the additional die 42*a*, it is possible to use the punch 47 and die 42 to set the clearance and perform the shearing operation and pushing operation of the processes (A) to (C) while keeping the workpiece from escaping to the outer circumferential side.

In this embodiment, using the holder 45*a* gives rise to a greater effect of preventing curvature of the workpiece, but use of the holder 45*a* is optional. The holder need not be used if it is possible to stably shear the workpiece.

(Sixth Embodiment of Outer Trimming)

In the fifth embodiment shown in FIG. 18A and FIG. 18B, after obtaining a sheared edge for constraint use, it is possible to make an additional die 42*a* and additional holder 45*a* move to constrain the left end of the sheared workpiece by a side surface of the additional holder 45*a*.

Figure 19A:
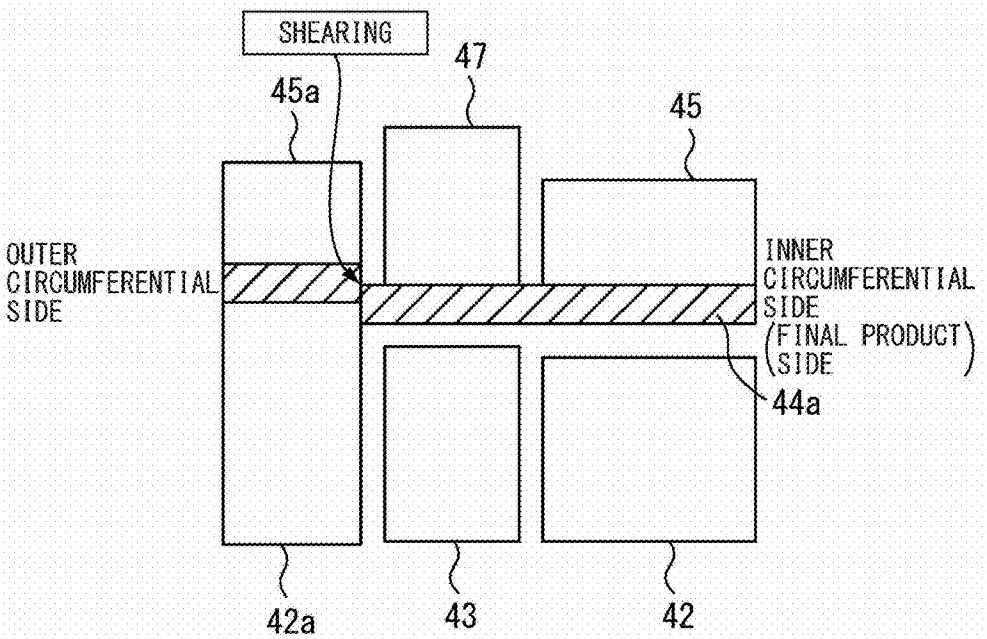
FIG. 19A and FIG. 19B are cross-sectional schematic views for explaining a sixth embodiment of outer trimming.
Figure 19B:
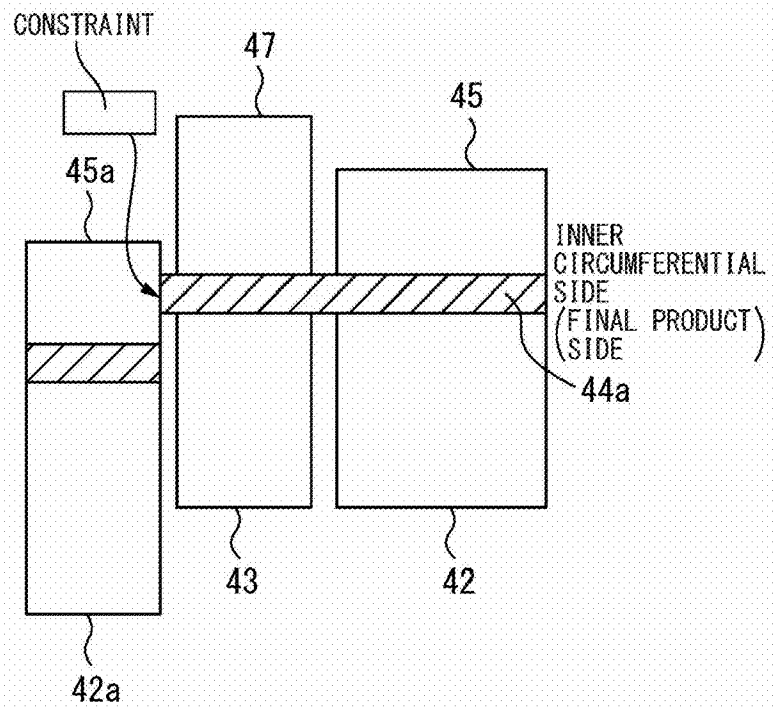

FIG. 19B is a cross-sectional schematic view of a mode where a left end of the sheared workpiece is constrained by a side surface of the additional holder 45*a*. Since the left end of the workpiece is constrained by a side surface of the additional holder 45*a*, it is possible to use the punch 47 and die 42 to set the clearance and perform the shearing operation and pushing operation of the processes (A) to (C) while keeping the workpiece from escaping to the outer circumferential side.

In general, a die and a punch are used for a shearing operation, while a holder is used in combination with the die to fasten the workpiece. Therefore, the die and punch are fabricated by a material with relatively high strength, the dimensional precision also is relatively high, the holder is prepared by a material with a relatively low strength, and the dimensional precision is relatively low. As opposed to this, in the above embodiment of an outer trimming operation, the die, holder, punch, and pushing punch used may be conventional ones and the die may be used as a holder. In the above embodiment of an outer trimming operation, for example, a side surface of the holder can be used to constrain the sheared edge, but in this case, a holder fabricated with a conventional material and dimensional precision may be used, a holder fabricated by the material and dimensional precision by which the die and punch were fabricated may be used, or the die may be used as a holder. The same is true for the die and punch.

The workpiece worked by the method of the present disclosure is a metal sheet having a tensile strength of preferably 340 MPa class or more, more preferably 980 MPa class or more. Still more preferably, the workpiece worked in the method of the present disclosure is a steel material having the above tensile strength. In a metal sheet having a 340 MPa class or more tensile strength, in particular, measures against fatigue fracture become necessary. If 980 MPa class or more, measures against hydrogen embrittlement cracking also become necessary. In particular, when the workpiece is a steel material, measures against hydrogen embrittlement cracking and fatigue fracture become necessary. The method of the present disclosure can be applied to all sorts of strengths of metal members. It can reduce the tensile residual stress even if applied to aluminum and other metal members besides steel, applied to low strength steel sheet, and applied to high strength steel sheet. The method of the present disclosure can simultaneously achieve hydrogen embrittlement resistance, fatigue strength, and stretch flangeability—which were difficult to achieve in the past—in particular by application to high strength steel sheet having the above tensile strength.

The sheet thickness of the workpiece worked by the method of the present disclosure is preferably 0.05 to 1000 mm, more preferably 0.1 to 100 mm, still more preferably 0.4 to 10 mm, even still more preferably 0.6 to 2 mm. By the sheet thickness of the workpiece being in the above range, it is possible to obtain the effect of reduction of the tensile residual stress without causing the workpiece to curve.

The vertical and horizontal dimensions of the workpiece worked by the method of the present disclosure are preferably 1 to 10000 mm, more preferably 10 to 5000 mm, still more preferably 100 to 1000 mm.

The worked material obtained by the method of the present disclosure preferably can be used in automobiles and other various vehicles, household electric appliances, building structures, ships, bridges, general machinery, construction machinery, various plants, penstocks, etc. For example, in auto part applications, the worked material is able to be further worked for use.

EXAMPLES

Next, examples of the present invention will be explained, but the conditions in the examples are illustrations of the conditions employed for confirming the workability and effect of the present invention—the present invention is not limited to these illustrations of conditions. The present invention can employ various conditions so long as not departing from the gist of the present invention and achieving the object of the present invention.

Example 1

Figure 20A:
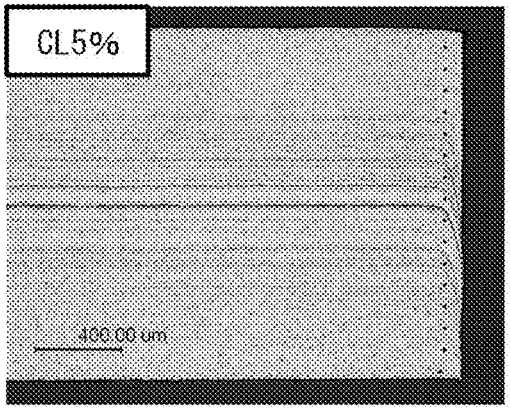
FIG. 20A is a cross-sectional photograph of a sheared edge in the case where a die clearance between a die and punch is 5% of a sheet thickness of a workpiece.
Figure 20B:
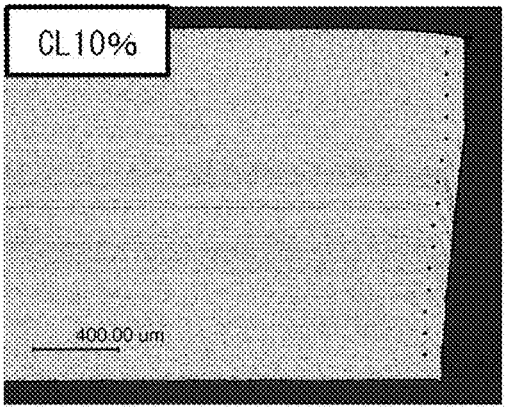
FIG. 20B is a cross-sectional photograph of a sheared edge in the case where a die clearance between a die and punch is 10% of a sheet thickness of a workpiece.
Figure 21B:
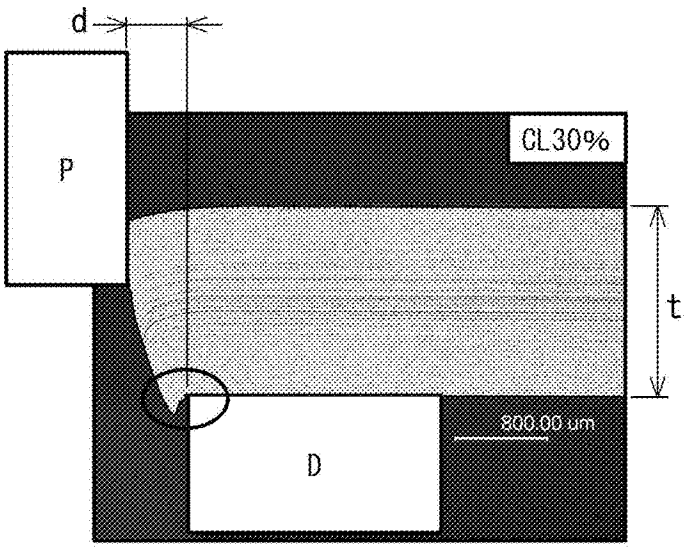
FIG. 21B is a cross-sectional photograph of a sheared edge in the case where a die clearance between a die (D) and punch (P) is 30% of a sheet thickness of a workpiece.
Figure 21A:
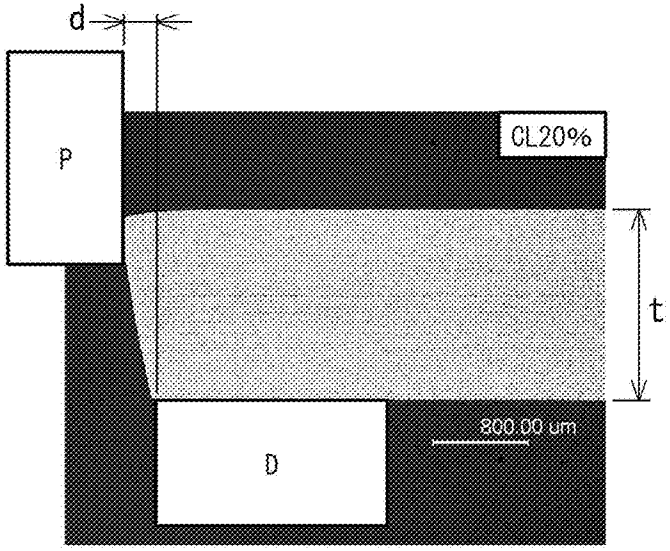
FIG. 21A is a cross-sectional photograph of a sheared edge in the case where a die clearance between a die (D) and punch (P) is 20% of a sheet thickness of a workpiece.
Figure 21C:
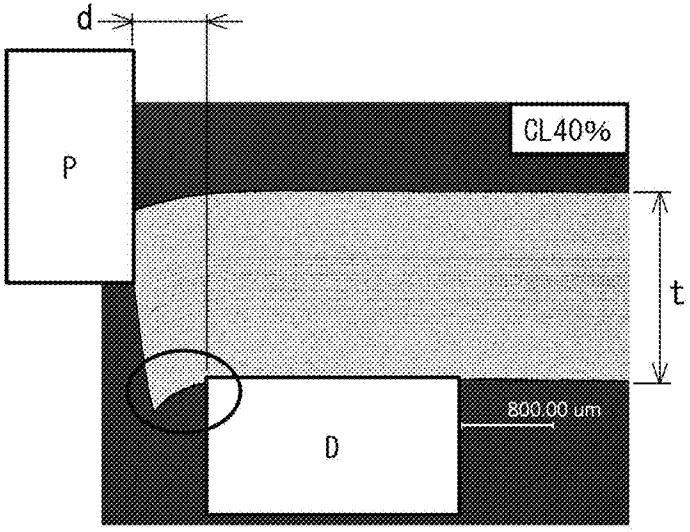
FIG. 21C is a cross-sectional photograph of a sheared edge in the case where a die clearance between a die (D) and punch (P) is 40% of a sheet thickness of a workpiece.

A 1180 MPa class DP steel sheet having a sheet thickness of 1.6 mm was prepared and a diameter ϕ10 mm punch was used for a shearing operation while changing the clearance "d". The cross-sectional shape of the sheared edge was evaluated. FIG. 20A and FIG. 20B are cross-sectional photographs of a sheared edge when the clearance "d" is 5% (CL5%) and 10% (CL10%) of the sheet thickness "t" of the workpiece. Here, the results are omitted, but the black points seen at the surface layer part of the sheared edge are the remaining traces of Vicker's hardness tests. FIGS. 21A to 21C are cross-sectional photographs of a sheared edge when the clearance "d" is 20% (CL20%), 30% (CL30%), and 40% (CL40%) of the sheet thickness "t" of the workpiece.

When the clearance "d" was 5% and 10% of the sheet thickness "t" of the workpiece, a crack formed toward the die edge and a sheared edge was formed. When the clearance "d" was 20% of the sheet thickness "t" of the workpiece, as shown in FIG. 21A, a crack formed toward the die edge and a sheared edge was formed. When the clearance "d" was 30% and 40% of the sheet thickness "t" of the workpiece, as shown in FIG. 21B and FIG. 21C, a crack formed offset from the die edge direction to the sheet thickness direction of the workpiece whereupon a sheared edge was formed and a burr was formed at the end part of the worked material.

Example 2

Except for adding an example where the die clearance "d" between the die and punch was 1% and 60%, the tensile residual stresses at the sheared edge in the case of not pushing the end face of the punched out material against the sheared edge of the worked material sheared under the same conditions as Example 1 and the case of pushing the end face of the punched out material were evaluated. When pushing the end face of the punched out material against the sheared edge of the worked material, the punched out material was pushed back to the original position of the punched hole so that the second surface of the punched out material became a position matching the second surface of the worked material.

Figure 22:
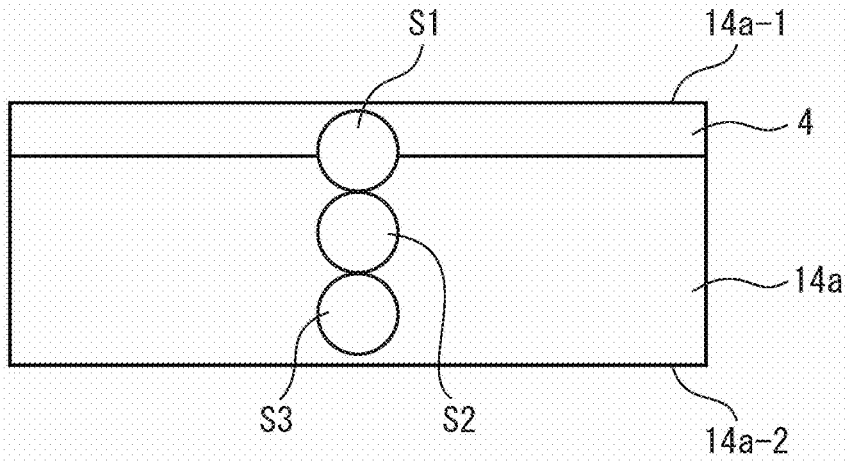
FIG. 22 is a schematic view showing measurement positions of residual stress at a sheared edge.
Figure 23:
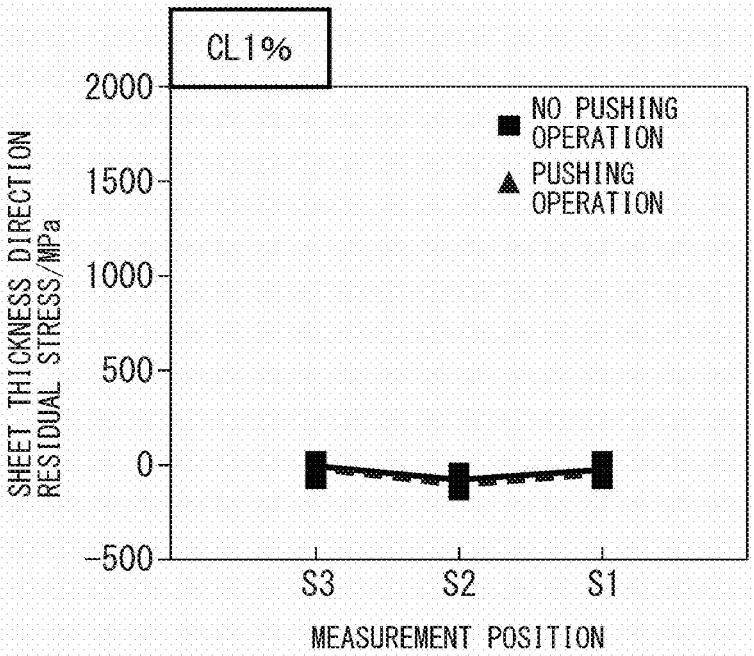
FIG. 23 is a graph showing a tensile residual stress at a sheared edge when a die clearance between a die and punch is 1% of a sheet thickness of the workpiece.
Figure 24:
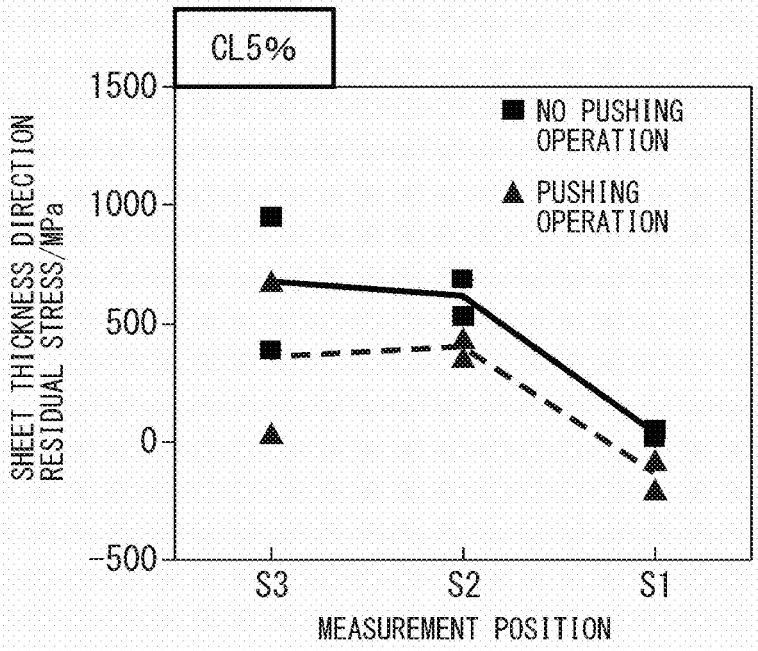
FIG. 24 is a graph showing a tensile residual stress at a sheared edge when a die clearance between a die and punch is 5% of a sheet thickness of a workpiece.
Figure 25:
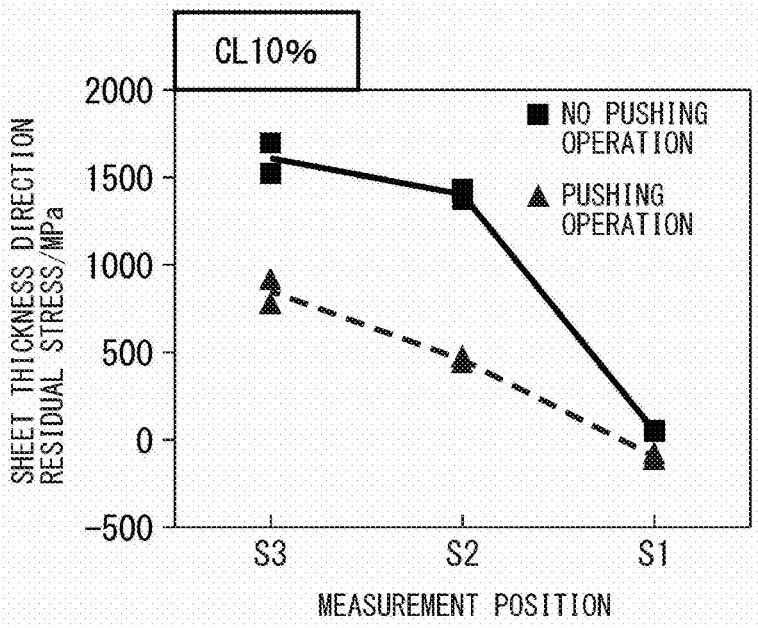
FIG. 25 is a graph showing a tensile residual stress at a sheared edge when a die clearance between a die and punch is 10% of a sheet thickness of a workpiece.
Figure 26:
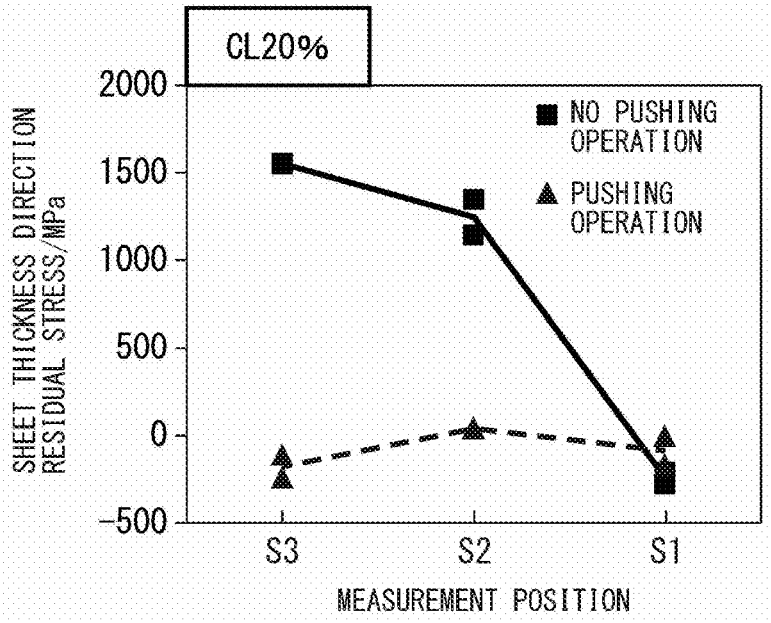
FIG. 26 is a graph showing a tensile residual stress at a sheared edge when a die clearance between a die and punch is 20% of a sheet thickness of a workpiece.
Figure 27:
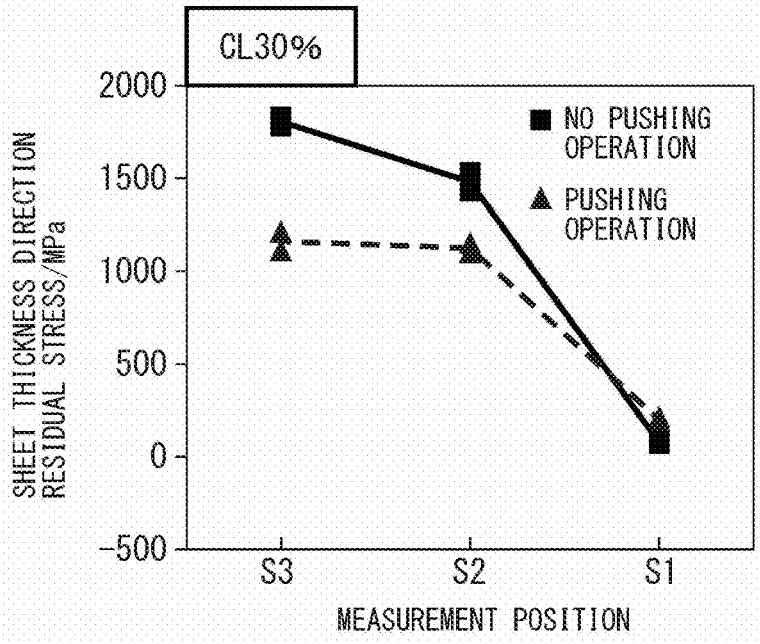
FIG. 27 is a graph showing a tensile residual stress at a sheared edge when a die clearance between a die and punch is 30% of a sheet thickness of a workpiece.
Figure 28:
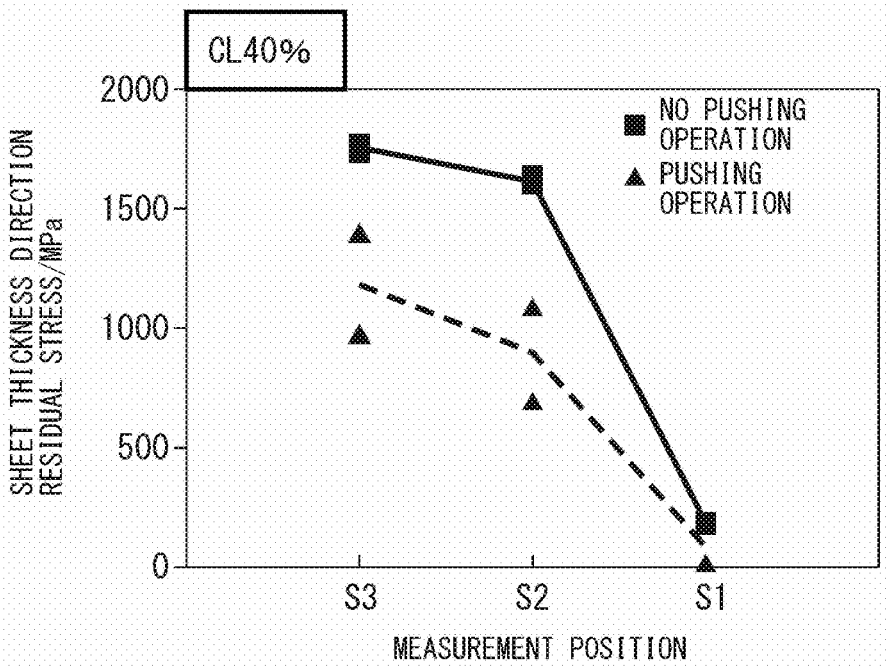
FIG. 28 is a graph showing a tensile residual stress at a sheared edge when a die clearance between a die and punch is 40% of a sheet thickness of a workpiece.
Figure 29:
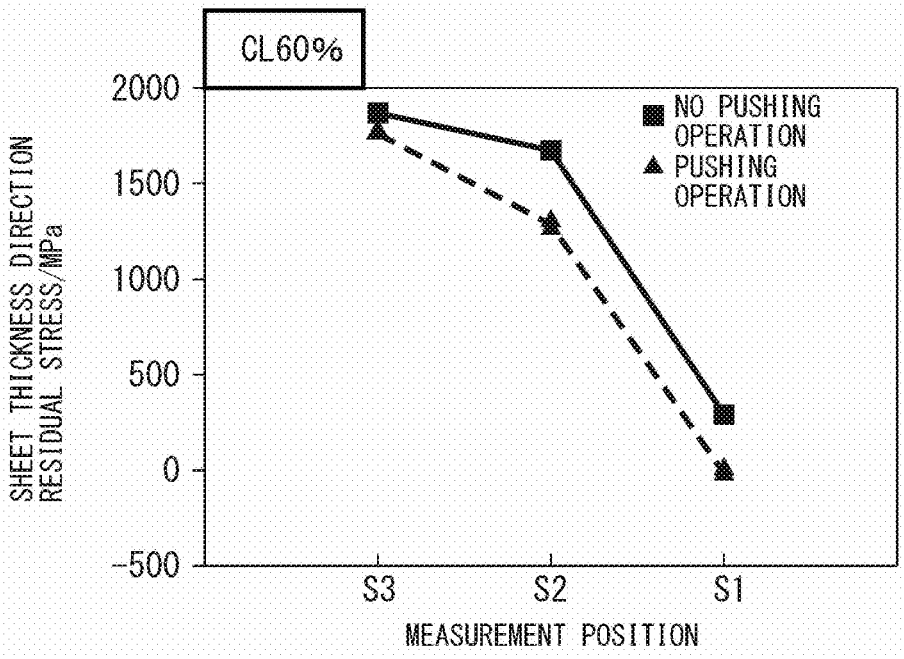
FIG. 29 is a graph showing a tensile residual stress at a sheared edge when a die clearance between a die and punch is 60% of a sheet thickness of a workpiece.

FIG. 22 is a schematic view of the measurement positions of a tensile residual stress at a sheared edge. As shown in FIG. 22, the worked material is cut at the line passing through the center of the punched hole, a spot diameter 500 μm X-ray is fired at three points along the sheet thickness direction of the sheared edge of the worked material 14*a*, that is, the second surface 14*a*-2 side position of the worked material 14*a* (s3), the position at the center of sheet thickness (s2), and the first surface side position of the worked material 14*a* (s1), so as not to overlap with each other so as to measure the tensile residual stress at those positions using the $\sin^2\Psi$ method.

FIGS. 23 to 29 show the tensile residual stress at a sheared edge of a worked material at the three points of position of the position (s3), position (s2), and position (s1) when not pushing and when pushing the end faces of the punched out material when the clearance "d" is 1%, 5%, 10%, 20%, 30%, 40%, and 60% (CL1%, CL5%, CL10%, CL20%, CL30%, CL40%, and CL60%) of the sheet thickness "t" of the workpiece.

When the clearance "d" was 5% or more of the sheet thickness "t" of the workpiece, the tensile residual stress was reduced at the position (s3) and position (s2). Further, when the clearance "d" was 5 to 40% of the sheet thickness "t" of the workpiece, the tensile residual stress was reduced while variation of the tensile residual stress was also reduced.

When the clearance "d" was 10 to 20% of the sheet thickness "t" of the workpiece, the tensile residual stress at the position (s3) and position (s2) greatly fell. When the clearance "d" was 20% of the sheet thickness "t" of the workpiece, the residual stress in the sheet thickness direction became compression and became substantially uniform.

When the clearance "d" is about 1% of the sheet thickness "t" of the workpiece, even with the conventional method, the tensile residual stress becomes small, but becomes the same as when performing so-called precision shearing. Therefore, a high tooling precision is demanded, the cost of fabrication of the tooling becomes high, it becomes particularly difficult to fabricate the tooling for high strength steel sheet, the tooling is easily damaged, furthermore, the burnished surface is formed long toward the direction of punch advance, work hardening is greatly imparted, and therefore the stretch flangeability of the sheared edge also can fall.

Figure 30:
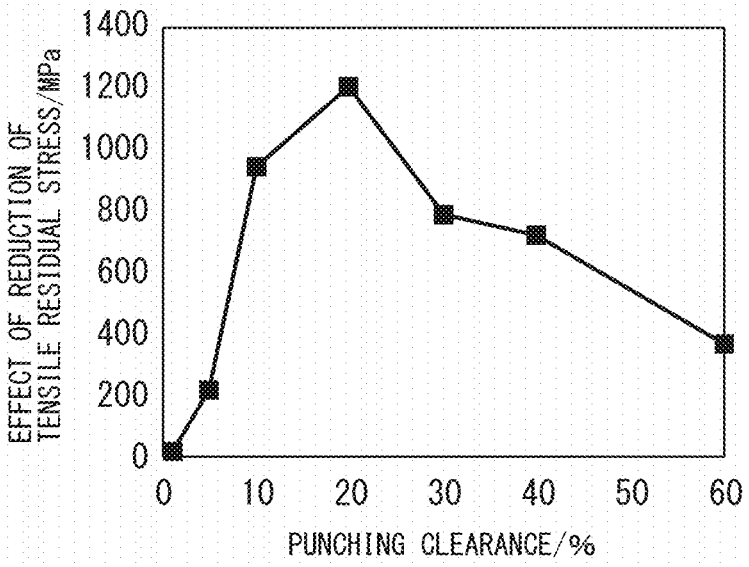
FIG. 30 is a graph showing an effect of reduction of a tensile residual stress by a die clearance between a die and punch.

FIG. 30 shows the effect of reduction of residual stress when changing the die clearance between the die and punch (punching clearance) at the center position of sheet thickness (s2) shown in FIGS. 23 to 29. When the die clearance between the die and punch was 5% or more of the sheet thickness of the workpiece, the effect of reduction of the tensile residual stress was obtained, when 10% to 40%, a greater effect of reduction of the tensile residual stress was obtained, when 10% to 30%, a further greater effect of reduction of the tensile residual stress was obtained, while when 10% to 20%, a still further greater effect of reduction of the tensile residual stress was obtained. The reason why when 10% to 20%, a large effect of reduction of the tensile residual stress was obtained was believed to be when the die clearance between the die and punch was 20% or less, the burrs formed were kept small in size.

Figure 31:
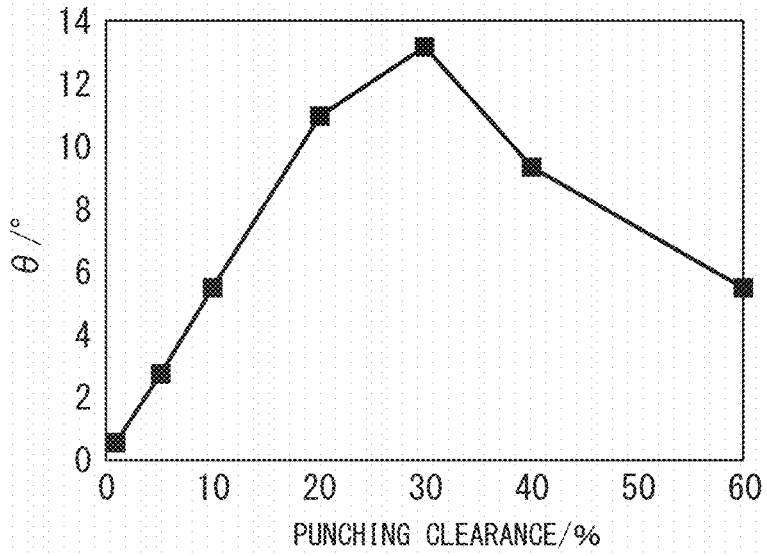
FIG. 31 is a graph showing an angle θ of a fracture surface of the worked material with respect to a direction of punch advance according to a die clearance between a die and punch.

FIG. 31 shows the relationship between the die clearance between the die and punch (punching clearance) and the angle θ of the fracture surface when not pushed together for the worked material evaluated in FIGS. 23 to 29. The angle θ of the fracture surface of the worked material is the angle with respect to the direction of punch advance (sheet thickness direction). When the die clearance between the die and punch was 5% or more of the sheet thickness of the workpiece, a 3° or more angle θ of the fracture surface was obtained. When the die clearance between the die and punch was 10% to 60%, 20% to 40%, and 20 to 30% in range, a greater angle θ of the fracture surface was obtained.

Table 1 shows the relationship between the die clearance "d" between the die and punch and the angle θ of the fracture surface of the worked material.

TABLE 1

| Clearance "d" between die and punch | Angle θ of fracture surface |
|---|---|
| 1% | 0.5° |
| 5% | 3° |
| 10% | 5.5° |
| 20% | 11° |
| 30% | 13° |
| 40% | 9.5° |
| 60% | 5.5° |

Figure 32:
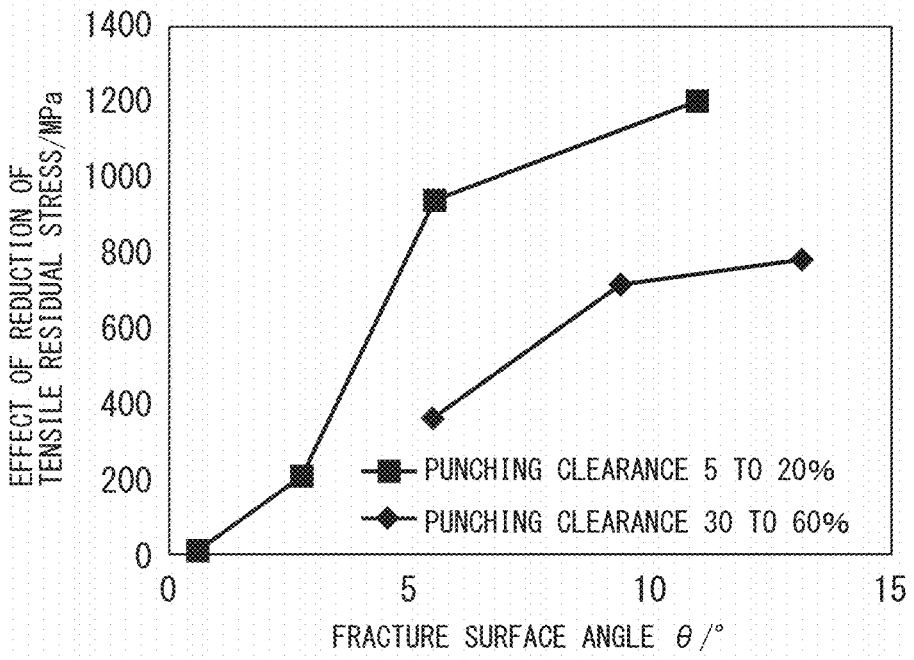
FIG. 32 is a graph showing an effect of reduction of a tensile residual stress by an angle θ of the fracture surface.

FIG. 32 shows the relationship between the angle θ of the fracture surface and the effect of reduction of the tensile residual stress in the case where the die clearance between the die and punch (punching clearance) is 5 to 20% and the case where it is 30 to 60%. The data shown in FIG. 32 is based on the results of FIGS. 30 and 31. When the angle θ of the fracture surface was 3° or more, a large effect of reduction of the tensile residual stress was obtained. Further, when the die clearance between the die and punch (punching clearance) was 5 to 20%, compared with when the die clearance between the die and punch (punching clearance) was 30 to 60%, a greater effect of reduction of the tensile residual stress was obtained with respect to the same angle θ of the fracture surface.

Example 3

The average tensile residual stress of the sheared edge when pushing and not pushing the punched out material when making the die clearance "d" between the die and punch 20% in Example 2 was evaluated.

The average tensile residual stress of the sheared edge of the worked material when pushing against it by the punched out material and the average tensile residual stress of the sheared edge when not pushing against it by the punched out material were calculated and compared. The results are shown in Table 2.

TABLE 2

| Sheet thickness t | Clearance "d" between die and punch | Average tensile residual stress in case of no pushing operation | Average tensile residual stress in case of pushing operation |
|---|---|---|---|
| 1.6 mm | 20% (0.32 mm) | 895 MPa | −83 MPa |

From Table 2, it is learned that by pushing the punched out material, compressive stress is given to the sheared edge and the tensile residual stress of the sheared edge of the worked material is reduced.

Example 4

The hydrogen embrittlement characteristics at the sheared edge when not pushing the end face of the punched out material against it under the same conditions as Example 2 and when pushing the end face of the punched out material against it were investigated for steel sheets sheared under the same conditions as in Example 1 with a die clearance "d" between the die and punch of 5%, 10%, and 20%. The hydrogen embrittlement characteristics were evaluated by dipping a test steel sheet in a specific liquid volume 15 ml/cm$^2$, 1 to 100 g/liter ammonium thiocyanate solution for 72 hours. The results are shown in Tables 3 and 4. The presence of any hydrogen embrittlement cracking was evaluated by visual observation.

TABLE 3

Cracking of Sample When Not Pushing Against It by Punched Out Material

| Concentration of ammonium thiocyanate (%) | 1 g/liter | 10 g/liter | 50 g/liter | 100 g/liter |
|---|---|---|---|---|
| CL5% | None | Yes | Yes | Yes |
| CL10% | None | Yes | Yes | Yes |
| CL20% | None | Yes | Yes | Yes |

TABLE 4

Cracking of Sample When Pushing Against It by Punched Out Material

| Concentration of ammonium thiocyanate (%) | 1 g/liter | 10 g/liter | 50 g/liter | 100 g/liter |
|---|---|---|---|---|
| CL5% | None | None | Yes | Yes |
| CL10% | None | None | None | Yes |
| CL20% | None | None | None | None |

As shown in Tables 3 and 4, by pushing the end faces of the punched out material against the sheared edge of the worked material, the hydrogen embrittlement characteristics are greatly improved.

Example 5

Figure 33:
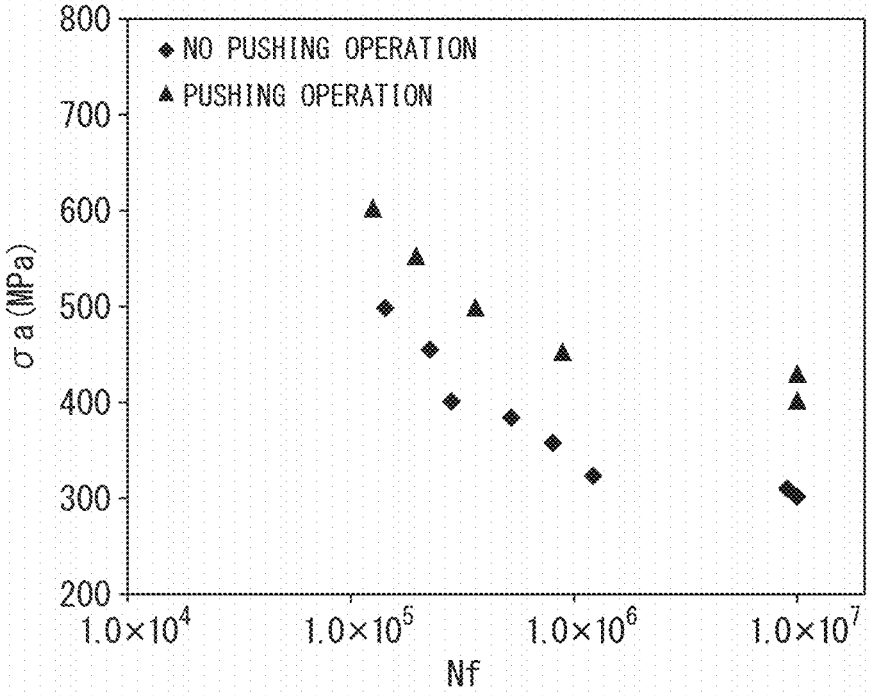
FIG. 33 is a graph showing fatigue characteristics measured in a plate bending fatigue test.

The fatigue characteristics of the sheared edge of a steel sheet due to pushing of the punched out material were evaluated. As the workpiece, a 1180 MPa class DP steel sheet having a sheet thickness of 1.6 mm was prepared. The clearance "d" between the die and a diameter 10 mm punch was made 20% of the sheet thickness of the steel sheet, that is, 0.32 mm, and the material was sheared to obtain the worked material and punched out material. Next, the punched out material was pushed against the punched hole to coin the sheared edge of the worked material so that the second surface of the punched out material became aligned with the position of the second surface of the worked material. The worked materials obtained by no pushing operation and by a pushing operation were subjected to plate bending fatigue tests with a stress ratio of −1 and frequency of 25 Hz at room temperature in the atmosphere. FIG. 33 shows the fatigue characteristics measured in a plate bending fatigue test (σa: fatigue limit, Nf: number of times of flexing). From FIG. 33, it is learned that by pushing and coining the end face of the punched out material against the sheared edge of the worked material, the tensile residual stress falls and the fatigue characteristics are improved.

Example 6

The relationship between the returned position of the punched out material and the stretch flangeability of the sheared edge of the worked material was investigated. Specifically, the stretch flangeability of the sheared edge of the worked material was investigated in the case of only performing a shearing operation, the case of shearing, then returning the punched out material 18 to a position where the second surface 182 of the punched out material 18 is aligned with the second surface **14*a*-2 of the worked material, that is, the original position, and the case of shearing, then making the punched out material 18 pass through the punched hole 18*a*. As the workpiece 14**, a 1180 MPa class DP steel sheet having a sheet thickness of 1.6 mm was prepared. A diameter ϕ10 mm punch was used for shearing with a clearance "d" of 20%.

Figure 34:
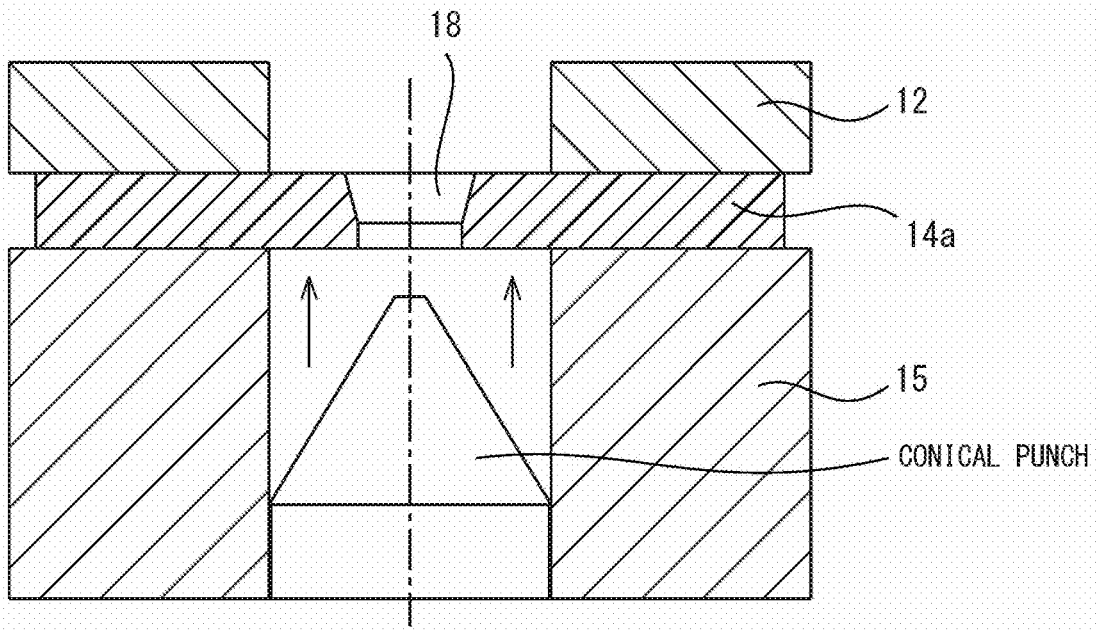
FIG. 34 is a cross-sectional schematic view showing a test method of stretch flangeability.

To test the stretch flangeability, the test method shown in FIG. 34 was used to evaluate the worked material by a hole expanding test. For the hole expanding test, a vertical angle 60° conical punch was used, the wrinkle suppressing load was made 9.8 kN, the punch speed at the time of hole expansion was made about 0.2 mm/sec, the test piece of the worked material **14*a* was set so that the burr became the top side, and the test piece was fastened by the die 12 and holder 15**. The rest of the conditions were based on ISO 16630 (2009). The hole expanding test was performed 10 times each for the respective experimental conditions.

Figure 35:
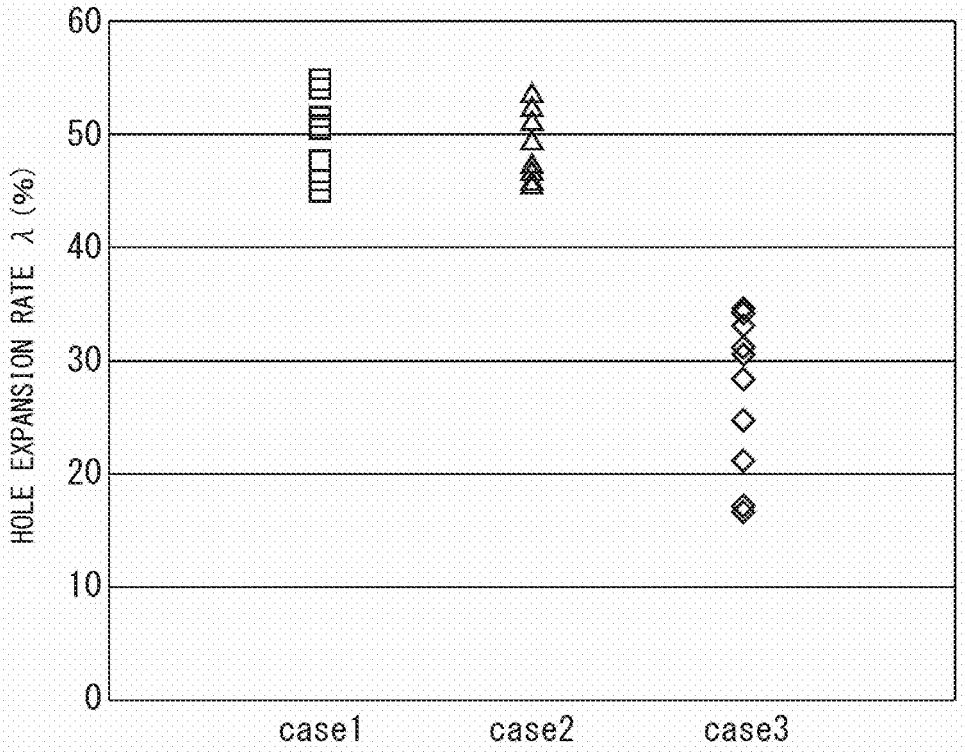
FIG. 35 is a graph showing the test results for the stretch flangeability of the sheared edge of the worked material.

FIG. 35 shows a graph comparing the stretch flangeability of the sheared edge of the worked material in the case of only performing a shearing operation (Case 1: only punching), the case of shearing, then returning the punched out material 18 to the punched hole **18*a* (Case 2: punching+coining), and the case of shearing, then making the punched out material 18 pass through the punched hole 18*a*** (Case 3: punching+shaving).

In Case 3, if the punched out material 18 is passed through the punched hole **18*a*, the sheared edge of the worked material is shaved and the sheared edge is given a large compressive stress whereby work hardening ends up being given, so the stretch flangeability ends up falling. In Case 2, the punched out material 18 is returned to the original position of the punched hole 18*a*** whereby the sheared edge is coined and excellent stretch flangeability is obtained. While not shown here, if comparing Case 1 and Case 2, at Case 2, coining is performed, so compared with Case 1, excellent hydrogen embrittlement resistance and fatigue strength can be obtained.

Example 7

As the workpiece, a 1180 MPa class DP steel sheet having a sheet thickness of 1.6 mm was prepared. The clearance "d" of the die and a diameter 10 mm punch was made 20% of the sheet thickness of the steel sheet, that is, 0.32 mm. Under these conditions, a punch was used to shear the steel sheet to obtain a worked material and a punched out material. The punched out material was pushed into and made to pass through the punched hole in the state as punched, then the punched out material was again pushed into and made to pass through the punched hole from the opposite side to push the end face of the punched out material against the sheared edge of the steel sheet.

The worked material which was not pushed against and the worked material which was pushed against were cut at lines passing through the center of the punched hole. At three points along the sheet thickness direction of the worked material, that is, the second surface side position of the worked material (s3), the position at the center of sheet thickness (s2), and the first surface side position of the worked material (s1), a spot diameter 500 μm X-ray was fired so as not to overlap and the $\sin^2\Psi$ method was used to investigate and compare the average tensile residual stress at those positions. The results are shown in Table 5.

TABLE 5

| | No pushing operation | Pushing operation | After second pushing operation |
|---|---|---|---|
| Average tensile residual stress | 895 MPa | −154 MPa | −193 MPa |

INDUSTRIAL APPLICABILITY

As explained above, according to the present invention, in shearing a steel material, a steel material having a sheared edge excellent in surface properties can be produced with a good productivity and at a low cost. Accordingly, the present invention is high in applicability in industries producing steel materials.

REFERENCE SIGNS LIST

1. workpiece
2. punch
2*a*. downward direction
3. die
4. shear droop
5. burnished surface
6. fracture surface
6*a*. fracture surface
7. burr
8*a*. top part surface
8*b*. bottom part surface
9. sheared edge
10. worked material
11. elastic member
12. die
12*a*. die edge
13. pushing punch
14. workpiece
14*a*. worked material
15. holder
16. elastic member
17. punch
17*a*. punch edge
18. punched out material
18*a*. punched hole
19. end face
20. sheared edge
20*a*. overlapping material region
21. elastic member
22. die
23. pushing punch
24. workpiece
24*a*. worked material
25. holder
26. elastic member
27. punch
28. punched out material
28*a*. punched hole
29. end face
30. sheared edge
32. machine frame
42. die
42*a*. additional die
43. pushing punch
43*a*. additional pushing punch
44. workpiece
45. holder
45*a*. additional holder
47. punch
47*a*. additional punch
49. projecting part
100. shearing machine
200. cantilever type shearing machine
d. clearance between punch and die
t. sheet thickness of workpiece
s1, s2, s3. measurement positions of residual stress

The invention claimed is:

1. A shearing method in which a workpiece having a first surface and a second surface on an opposite side of the first surface is arranged on a die so that the second surface is arranged at a die side and the workpiece is sheared from the first surface toward the second surface in a sheet thickness direction of the workpiece by a punch arranged at the first surface side, wherein the shearing method comprises:

(A) a clearance setting process of snaking a clearance between the die and the punch in a direction perpendicular to the sheet thickness direction of the workpiece which is set between 5% to 80% of the sheet thickness of the workpiece, (B) a shearing process of using the punch to shear the workpiece to obtain a punched out material and a worked material having a punched hole, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, and pushing the second surface of the punched out material towards the punched hole of the worked material created in the workpiece in the shearing process so that the punched out material is pushed against a sheared edge of the worked material, wherein the die, the punch, and the pushing punch are arranged so that the punch and the pushing punch are disposed at a peripheral side of the workpiece, and the die is disposed at an inner side relative to the punch and the pushing punch of the workpiece, an additional punch is linked to the punch so that the additional punch is disposed at the first surface side of the workpiece at a further peripheral side from the punch, an additional pushing punch is linked to the pushing punch so that the additional pushing punch is disposed at the second surface side of the workpiece and opposed to the additional punch across the workpiece, at least one of a punching surface of the additional punch and a pushing surface of the additional pushing punch has a projecting part, and the shearing process and the pushing process are conducted while the workpiece is gripped and fastened between the punching surfaces of the punch and the additional punch and the pushing surfaces of the pushing punch and the additional pushing punch.

2. The shearing method according to claim 1, wherein, in the process (A), the clearance between the die and the punch is set between 10% to 30% of the sheet thickness.

3. The shearing method according to claim 1, wherein, in the process (C), the punched out material is pushed to a position where the second surface of the punched out material does not pass the first surface of the worked material, so as to coin the sheared edge of the worked material.

4. The shearing method according to claim 1, wherein the workpiece is a metal sheet having a 980 MPa class or more tensile strength.

5. The shearing method according to claim 1, wherein the workpiece is a steel material.

6. A shearing method in which a workpiece having a first surface and a second surface on an opposite side of the first surface is arranged between a die provided on a side of the second surface and a holder provided on a side of the first surface and the workpiece is sheared from the first surface toward the second surface in a sheet thickness direction of the workpiece by a punch arranged at the first surface side while the die and the holder are fastening the workpiece, wherein the shearing method comprises:

(A) a clearance setting process of making a clearance between the die and the punch in a direction perpendicular to the sheet thickness direction of the workpiece which is set between 5% to 80% of the sheet thickness of the workpiece, (B) a shearing process of using the punch to shear the workpiece to obtain a punched out material and a worked material having a punched hole, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, and pushing the second surface of the punched out material towards the punched hole of the worked material created in the workpiece during the shearing process so that the punched out material is pushed against a sheared edge of the worked material, wherein:

the die, the punch, and the pushing punch are arranged so that the punch and the pushing punch are disposed at a peripheral side of the workpiece, and the die is disposed at an inner side relative to the punch and the pushing punch of the workpiece, an additional holder is arranged at the first surface side of the workpiece at a further peripheral side from the punch, an additional die is arranged at the second surface side of the workpiece at a further peripheral side from the pushing punch so as to be opposed to the additional holder across the workpiece, at least one of a fastening surface of the additional holder facing the first surface of the workpiece and a fastening surface of the additional die facing the second surface of the workpiece has a projecting part, and the shearing and the pushing are conducted while the workpiece is gripped and fastened between the fastening surface of the additional holder and the fastening surface of the additional die.

7. The shearing method according to claim 6, wherein, in the process (A), the clearance between the die and the punch is set between 10% to 30% of the sheet thickness.

8. The shearing method according to claim 6, wherein, in the process (C), the punched out material is pushed to a position where the second surface of the punched out material does not pass the first surface of the worked material, so as to coin the sheared edge of the worked material.

9. The shearing method according to claim 6, wherein the workpiece is a metal sheet having a 980 MPa class or more tensile strength.

10. The shearing method according to claim 6, wherein the workpiece is a steel material.

11. A shearing method in which a workpiece having a first surface and a second surface on an opposite side of the first surface arranged on a die so that the second surface is arranged at a die side and the workpiece is sheared from the first surface toward the second surface in a sheet thickness direction of the workpiece by a punch arranged at the first surface side, wherein the shearing method comprises:

(A) a clearance setting process of making a clearance between the die and the punch in a direction perpendicular to the sheet thickness direction of the workpiece which is set between 5% to 80% of the sheet thickness of the workpiece, (B) a shearing process of using the punch to shear the workpiece to obtain a punched out material and a worked material having munched hole, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, and pushing the second surface of the punched out material towards the punched hole of the worked material created in the workpiece during the shearing process so that the punched out material is pushed against a sheared edge of the worked material, wherein the die, the punch, and the pushing punch are arranged so that the punch and the pushing punch are disposed at a peripheral side of the workpiece, and the die is disposed at an inner side relative to the punch and the pushing punch of the workpiece, an additional punch is arranged at the first surface side of the workpiece at a further peripheral side from the punch, the workpiece is sheared at a clearance between the additional punch and the pushing punch by moving the additional punch relative to the pushing punch to obtain a burnished surface, and the clearance setting, the shearing and the pushing are conducted while the burnished surface is being constrained by the additional punch.

12. The shearing method according to claim 11, wherein, in the process (A), the clearance between the die and the punch is set between 10% to 30% of the sheet thickness.

13. The shearing method according to claim 11, wherein, in the process (C), the punched out material is pushed to a position where the second surface of the punched out material does not pass the first surface of the worked material, so as to coin the sheared edge of the worked material.

14. The shearing method according to claim 11, wherein the workpiece is a metal sheet having a 980 MPa class or more tensile strength.

15. The shearing method according to claim 11, wherein the workpiece is a steel material.

16. A shearing method in which a workpiece having a first surface and a second surface on an opposite side of the first surface is arranged on a die so that the second surface is arranged at a die side and the workpiece is sheared from the first surface toward the second surface in a sheet thickness direction of the workpiece by a punch arranged at the first surface side, wherein the shearing method comprises:

(A) a clearance setting process of making a clearance between the die and the punch in direction perpendicular to the sheet thickness direction of the workpiece which is set between 5% to 80% of the sheet thickness of the workpiece, (B) a shearing process of using the punch to shear the workpiece to obtain a punched out material and a worked material, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, and pushing the second surface of the punched out material towards a punched out portion of the worked material created in the workpiece during the shearing process so that the lunched out material is pushed against a sheared edge of the worked material, wherein the die, the punch, and the pushing punch are arranged so that the punch and the pushing punch are disposed at a peripheral side of the workpiece, and the die is disposed at an inner side relative to the punch and the pushing punch of the workpiece, an additional die is arranged at the second surface side of the workpiece at a further peripheral side from the pushing punch, the workpiece is sheared at a clearance between the punch and the additional die by moving the additional die relative to the punch to obtain a burnished surface, and the clearance setting, the shearing and the pushing are conducted while the burnished surface is being constrained by the additional die.

17. The shearing method according to claim 16, wherein, in the process (A), the clearance between the die and the punch is set between 10% to 30% of the sheet thickness.

18. The shearing method according to claim 16, wherein, in the process (C), the punched out material is pushed to a position where the second surface of the punched out material does not pass the first surface of the worked material, so as to coin the sheared edge of the worked material.

19. The shearing method according to claim 16, wherein the workpiece is a metal sheet having a 980 MPa class or more tensile strength.

20. The shearing method according to claim 16, wherein the workpiece is a steel material.

21. A shearing method in which a workpiece having a first surface and a second surface on an opposite side of the first surface is arranged between a die provided on a side of the second surface and a holder provided on a side of the first surface and the workpiece is sheared from the first surface toward the second surface in a sheet thickness direction of the workpiece by a punch arranged at the first surface side while the die and the holder are fastening the workpiece, wherein the shearing method comprises;

(A) a clearance setting process of making a clearance between the die and the punch in a direction perpendicular to the sheet thickness direction of the workpiece which is set between 5% to 80% of the sheet thickness of the workpiece, (B) a shearing process of using the punch to shear the workpiece to obtain a punched out material and a worked material, wherein the punched out material and the worked material respectively have a first surface and a second surface corresponding to the first surface and the second surface of the workpiece, and (C) a pushing process of using a pushing punch arranged at the second surface side of the worked material so as to be opposed to the punch, and pushing the second surface of the punched out material towards a punched out portion of the worked material created in the workpiece during the shearing process so that the punched out material is pushed against a sheared edge of the worked material, wherein the die, the punch, and the pushing punch are arranged so that the punch and the pushing punch are disposed at a peripheral side of the workpiece, and the die is disposed at an inner side relative to the punch and the pushing punch of the workpiece, an additional holder is arranged on the first surface side of the workpiece at a further peripheral side from the punch, an additional die is arranged at the second surface side of the workpiece at a further peripheral side from the pushing punch so as to be opposed to the additional holder across the workpiece, the workpiece is sheared at a clearance between the punch and the additional die by moving the additional die relative to the punch to obtain a burnished surface, and the clearance setting, the shearing and the pushing are conducted while the burnished surface is being constrained by the additional die or the additional holder.

22. The shearing method according to claim 21, wherein, in the process (A), the clearance between the die and the punch is set between 10% to 30% of the sheet thickness.

23. The shearing method according to claim 21, wherein, in the process (C), the punched out material is pushed to a position where the second surface of the punched out material does not pass the first surface of the worked material, so as to coin the sheared edge of the worked material.

24. The shearing method according to claim 21, wherein the workpiece is a metal sheet having a 980 MPa class or more tensile strength.

25. The shearing method according to claim 21, wherein the workpiece is a steel material.

* * * * *